US007269965B2

(12) United States Patent
Kim et al.

(10) Patent No.: US 7,269,965 B2
(45) Date of Patent: Sep. 18, 2007

(54) BUILT-IN TYPE COMPRESSOR/CONDENSER UNIT FOR AIR CONDITIONER

(75) Inventors: In-Gyu Kim, Jinhae-Shi (KR); Young-Ju Bae, Changwon-Shi (KR); Jae-Hyung Koo, Changwon-Shi (KR); Byung-Il Park, Changwon-Shi (KR); Kycong-Ho Kim, Changwon-Shi (KR); Yang-Ho Kim, Changwon-shi (KR); Young-Ho Hong, Kimhae-Shi (KR); Kyeong-Wook Heo, Changwon-shi (KR); Kang-Wook Cha, Changwon-shi (KR); Si-Kyong Sung, Changwon-Shi (KR); Dong-Hyuk Lee, Jinhae-Shi (KR); Seong-Min Kang, Seoul (KR); Tac-Goun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 10/250,501

(22) PCT Filed: Apr. 18, 2003

(86) PCT No.: PCT/KR03/00796

§ 371 (c)(1),
(2), (4) Date: Jul. 3, 2003

(87) PCT Pub. No.: WO03/088731

PCT Pub. Date: Oct. 30, 2003

(65) Prior Publication Data

US 2004/0237559 A1 Dec. 2, 2004

(30) Foreign Application Priority Data

Feb. 26, 2003 (KR) ..... 10-2003-0012100

(51) Int. Cl.
*F25D 23/12* (2006.01)

(52) U.S. Cl. ..... 62/259.2; 62/508

(58) Field of Classification Search ..... 62/259.2, 62/507, 508, 428, 298; 165/122, 145
See application file for complete search history.

(56) References Cited

U.S. PATENT DOCUMENTS 4,723,419 A 2/1988 Kessler et al. ..... 62/507

(Continued)

FOREIGN PATENT DOCUMENTS

EP 1248049 A2 * 9/2002

(Continued)

OTHER PUBLICATIONS

Lee Kendrick: "Design Manual for Healing, Ventilation, Plumbing and Air Conditioning Systems," 3rd Ed. 1981, *Technical Standards Publications*, Arlington, Virginia.

(Continued)

*Primary Examiner*—Melvin Jones
(74) *Attorney, Agent, or Firm*—Fleshner & Kim, LLP

(57) ABSTRACT

The present invention discloses a built-in type outdoor unit for an air conditioner to provide an efficient installation structure for installing the outdoor unit increased in capacity due to high air conditioning capacity in a built-in type. The built-in type outdoor unit includes a louver frame being fixedly installed on a rectangular space inner wall formed on an outer wall of a building, being divided into a suction area and a discharge area, including a plurality of louver blades in each area, and sucking and discharging air through gaps between the louver blades, an outdoor unit casing being formed in a rectangular parallelepiped shape, being fixedly installed on the inside bottom of the building to contact the louver frame, having its one surface facing the suction area and the discharge area of the louver frame opened and the other surfaces closed, and being divided into a suction unit and a discharge unit corresponding to the suction area and the discharge area of the louver frame, a compressor installed in the suction unit of the outdoor unit casing, for compressing a refrigerant gas supplied from an indoor unit through pipe lines, an air-cooled condenser installed in the suction unit of the outdoor unit casing, for condensing the refrigerant gas from the compressor, and a sirocco cooling fan installed in the discharge unit of the outdoor unit casing, for supplying external air to the air-cooled condenser through the suction area, and discharging heat exchanged air through the discharge area.

64 Claims, 20 Drawing Sheets

U.S. PATENT DOCUMENTS

| | | | | |
|---|---|---|---|---|
| 5,255,969 | A | 10/1993 | Cox et al. | 312/236 |
| 6,431,257 | B1 * | 8/2002 | Sano et al. | 165/42 |
| 2002/0157415 | A1 | 10/2002 | Liu | 23/12 |
| 2005/0093779 | A1 | 5/2005 | Kim et al. | |

FOREIGN PATENT DOCUMENTS

| | | |
|---|---|---|
| EP | 1 376 524 | 1/2004 |
| JP | 54-18043 | 2/1979 |
| JP | 55-076198 | 6/1980 |
| JP | 03-213928 | 9/1991 |
| JP | 06-101873 | 4/1994 |
| JP | 08-027031 | 2/1996 |
| JP | 08-252610 | 9/1996 |
| JP | 10-058570 | 3/1998 |
| JP | 2001-044099 | 2/2001 |
| JP | 2002-149954 | 5/2002 |
| JP | 2002-310496 | 10/2002 |
| KR | S54-22963 | 2/1979 |
| KR | 09-18096 | 10/1991 |
| KR | 93-3099 | 3/1993 |
| KR | 93-8317 | 5/1993 |
| KR | 93-19106 | 9/1993 |
| KR | 94-22962 | 10/1994 |
| KR | 95-9258 | 4/1995 |
| KR | 20-1999-0025208 | 11/1999 |
| KR | 20-0180389 | 5/2000 |
| KR | 1020000049053 | 8/2000 |
| KR | 1020000069318 | 11/2000 |
| KR | 1020010067040 | 10/2001 |
| KR | 20-2003-0006065 | 2/2003 |
| KR | 20-0314904 | 5/2003 |

OTHER PUBLICATIONS

"Model MQL Indoor Air Handling Unit: Installation, Operation and Maintenance Manual," Apr. 2002, *Environmental Technologies*, Largo, FL. Part No. PX-00-0145.

"Blower Coil Air Handler - Air Terminal Devices 400 to 3000 cfm: Installation, Operation and Maintenance," Sep. 2002, *Trane*.

"M-Series Climate Changer Air Handlers, Sizes 3 to 120: Installation, Operation and Maintenance," *Trane*, Aug. 2002.

* cited by examiner

BUILT-IN TYPE COMPRESSOR/CONDENSER UNIT FOR AIR CONDITIONER

TECHNICAL FIELD

The present invention relates to an outdoor unit for an air conditioner, and more particularly to, a built-in type outdoor unit for an air conditioner which can be installed indoors.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication No. 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between the louver plates.

In addition, Japanese Laid-Open Patent Publication No. 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

However, a volume and weight of the outdoor unit has recently increased due to high air conditioning capacity. Moreover, the front suction/discharge type outdoor unit sucks air through the front surface, namely one surface, and thus has a smaller suction unit area than a conventional three-surface suction type outdoor unit, which increases suction resistance. Nevertheless, the conventional arts relate merely to technologies for inserting the outdoor unit into a space formed on an outer wall of a building. That is, there has never been suggested a structure for efficiently installing the front suction/discharge type outdoor unit having a gradually-increasing volume and weight in a built-in type, or a method for efficiently preventing increase of suction resistance in the front suction/discharge type outdoor unit having a large volume and weight.

DISCLOSURE OF THE INVENTION

An object of the present invention is to provide a realistic installation structure which can prevent increase of suction resistance in a front suction/discharge type outdoor unit, and easily built the outdoor unit having a gradually-increasing volume and weight in an outer wall of a commercial and/or residential building.

Another object of the present invention is to provide a cooling fan structure which can convert an outdoor unit sucking air from three sides and discharging it to a top surface into a front suction/discharge type, and handle increase of suction resistance in the outdoor unit.

Yet another object of the present invention is to provide a front suction/discharge type outdoor unit for an air conditioner which can obtain heat exchange efficiency equal to or greater than a general outdoor unit by supplying a cooling fan structure which can be efficiently applied to the outdoor unit.

Yet another object of the present invention is to provide a front suction/discharge type outdoor unit for an air conditioner which can be easily assembled by supplying a fan frame for stably fixing a cooling fan, and fan frame guides for fixedly coupling the fan frame to the outdoor unit.

Yet another object of the present invention is to provide a front suction/discharge type outdoor unit for an air conditioner which has a drainage structure for guaranteeing a stable function of a cooling fan by discharging rain or snow which may be inputted into the cooling fan through a front surface.

In order to achieve the above-described objects of the invention, there is provided a built-in type outdoor unit for an air conditioner, including: a louver frame being fixedly installed on a rectangular space inner wall formed on an outer wall of a building, being divided into a suction area and a discharge area, including a plurality of louver blades in each area, and sucking and discharging air through gaps between the louver blades; an outdoor unit casing being formed in a rectangular parallelepiped shape, being fixedly installed on the inside bottom of the building to contact the louver frame, having its one surface facing the suction area and the discharge area of the louver frame opened and the other surfaces closed, and being divided into a suction unit and a discharge unit corresponding to the suction area and the discharge area of the louver frame; a compressor installed in the suction unit of the outdoor unit casing, for compressing a refrigerant gas supplied from an indoor unit through pipe lines; an air-cooled condenser installed in the suction unit of the outdoor unit casing, for condensing the refrigerant gas from the compressor, and a sirocco cooling fan installed in the discharge unit of the outdoor unit casing, for supplying external air to the air-cooled condenser through the suction area, and discharging heat exchanged air through the discharge area.

Here, the louver frame includes an external frame composing a frame, and an internal frame being fastened to the external frame and including the louver blades.

Preferably, the sirocco cooling fan includes a diffuser having a cutoff angle of at least 90°.

Preferably, one of suction orifices of the sirocco cooling fan faces the surface contacting one opened surface facing the discharge area of the louver frame and being farthest from the suction unit among the other surfaces, the other orifice faces the suction unit, a motor of the sirocco cooling fan is positioned adjacently to the suction orifice below the surface of the outdoor unit casing, and the outdoor unit further includes a dividing plate for intercepting gaps between the cooling fan and the inside surface of the outdoor unit casing so that external air from the suction unit can be sucked through the suction orifice of the sirocco cooling fan facing the air-cooled condenser and discharged.

Preferably, the suction orifices of the sirocco cooling fan face the two surfaces contacting one opened surface facing the discharge area of the louver frame among the other surfaces, the motor of the sirocco cooling fan is installed adjacently to the suction orifice facing one of the two surfaces, a width of fan blades in the side where the motor is installed is smaller than that of fan blades in the opposite side, the motor of the sirocco cooling fan is installed adjacently to the suction orifice facing one side of the two surfaces, and the sirocco cooling fan is installed eccentrically to the side where the motor has been installed on a central line of the air-cooled condenser.

Preferably, the discharge unit of the outdoor unit casing further includes a fan supporting member for supporting the cooling fan, and the supporting member includes a fan frame for reinforcing and supporting the edges of the discharge unit, and a fan bracket for fixedly coupling at least one surface of a housing of the sirocco cooling fan to the fan frame.

Preferably, the fan frame includes a flange unit facing the inside of the discharge unit and contacting the housing of the sirocco cooling fan on the surface contacting one opened surface, and the outdoor unit further includes a coupling member for fixing the flange to the housing of the sirocco cooling fan.

Preferably, the outdoor unit casing is divided into a suction casing corresponding to the suction unit and a discharge casing corresponding to the discharge unit, the fan frame reinforces and supports the discharge casing, the outdoor unit further includes fan frame guides having their one sides coupled to the suction casing and their other sides contacting the fan frame, and the other sides of the fan frame guides contact the inside of the fan frame. Preferably, the outdoor unit further includes a coupling member for fixing the fan frame guides to the fan frame, and the ends of the other sides of the fan frame guides have inwardly-slanted surfaces.

Preferably, the housing of the sirocco cooling fan includes a drainage structure, and the drainage structure includes a drainage caved-in unit formed on the bottom of the housing, a drainage hole formed on the lowest surface of the caved-in unit, and a drainage hose extended from the drainage hole, or the drainage structure includes a drainage hole formed on the lowest surface of the housing, and a drainage hose extended from the drainage hole.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the suction unit of the outdoor unit casing, for compressing a refrigerant gas supplied from an indoor unit through pipe lines; an air-cooled condenser installed in the suction unit of the outdoor unit casing, for condensing the refrigerant gas from the compressor; and a sirocco cooling fan installed in the discharge unit of the outdoor unit casing, for supplying external air to the air-cooled condenser through the suction area, and discharging heat exchanged air through the discharge area, wherein a housing of the sirocco cooling fan is composed of a drainage structure.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the suction unit of the outdoor unit casing, for compressing a refrigerant gas supplied from an indoor unit through pipe lines; an air-cooled condenser installed in the suction unit of the outdoor unit casing, for condensing the refrigerant gas from the compressor, and a sirocco cooling fan installed in the discharge unit of the outdoor unit casing, for supplying external air to the air-cooled condenser through the suction area, and discharging heat exchanged air through the discharge area, wherein one of suction orifices of the sirocco cooling fan is connected to face the surface contacting one opened surface and being farthest from the suction unit among the other surfaces, and the other orifice is connected to face the suction unit.

According to another aspect of the invention, a front suction/discharge type outdoor unit for an air conditioner includes: an outdoor unit casing being formed in a rectangular parallelepiped shape, having its one surface externally opened and its other surfaces closed, and being divided into a suction unit and a discharge unit; a compressor installed in the suction unit of the outdoor unit casing, for compressing a refrigerant gas supplied from an indoor unit through pipe lines; an air-cooled condenser installed in the suction unit of the outdoor unit casing, for condensing the refrigerant gas from the compressor, and a sirocco cooling fan installed in the discharge unit of the outdoor unit casing, for supplying external air to the air-cooled condenser through the suction area, and discharging heat exchanged air through the discharge area, wherein suction orifices of the sirocco cooling fan are connected to face the two surfaces contacting one opened surface among the other surfaces.

BEST MODE FOR CARRYING OUT THE INVENTION

A built-in type outdoor unit for an air conditioner in accordance with the present invention will now be described in detail with reference to the accompanying drawings.

Figure 1:
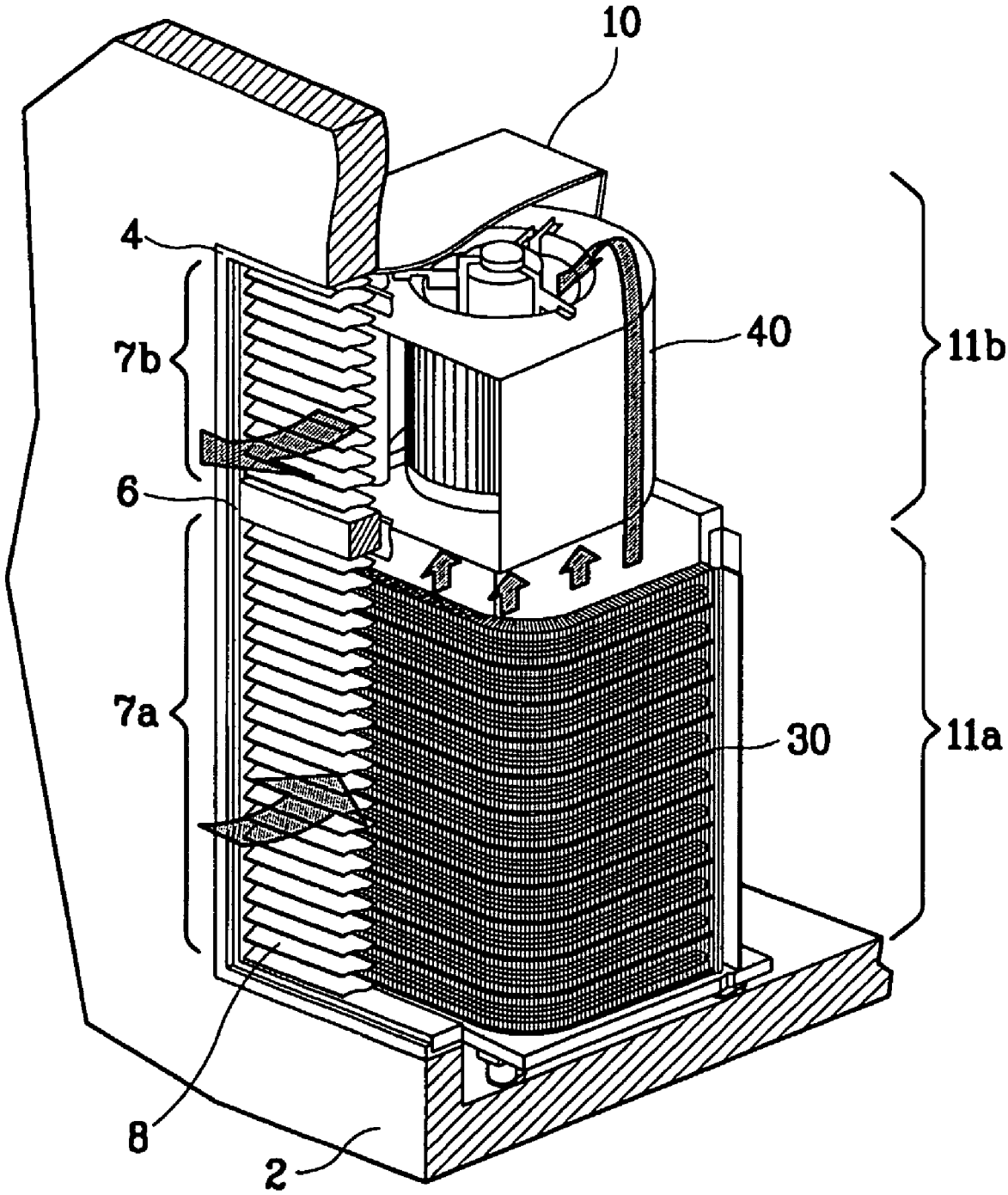
FIG. 1 is a partially-cut perspective-sectional view illustrating a built-in type outdoor unit for an air conditioner in accordance with a preferred embodiment of the present invention.
Figure 2:
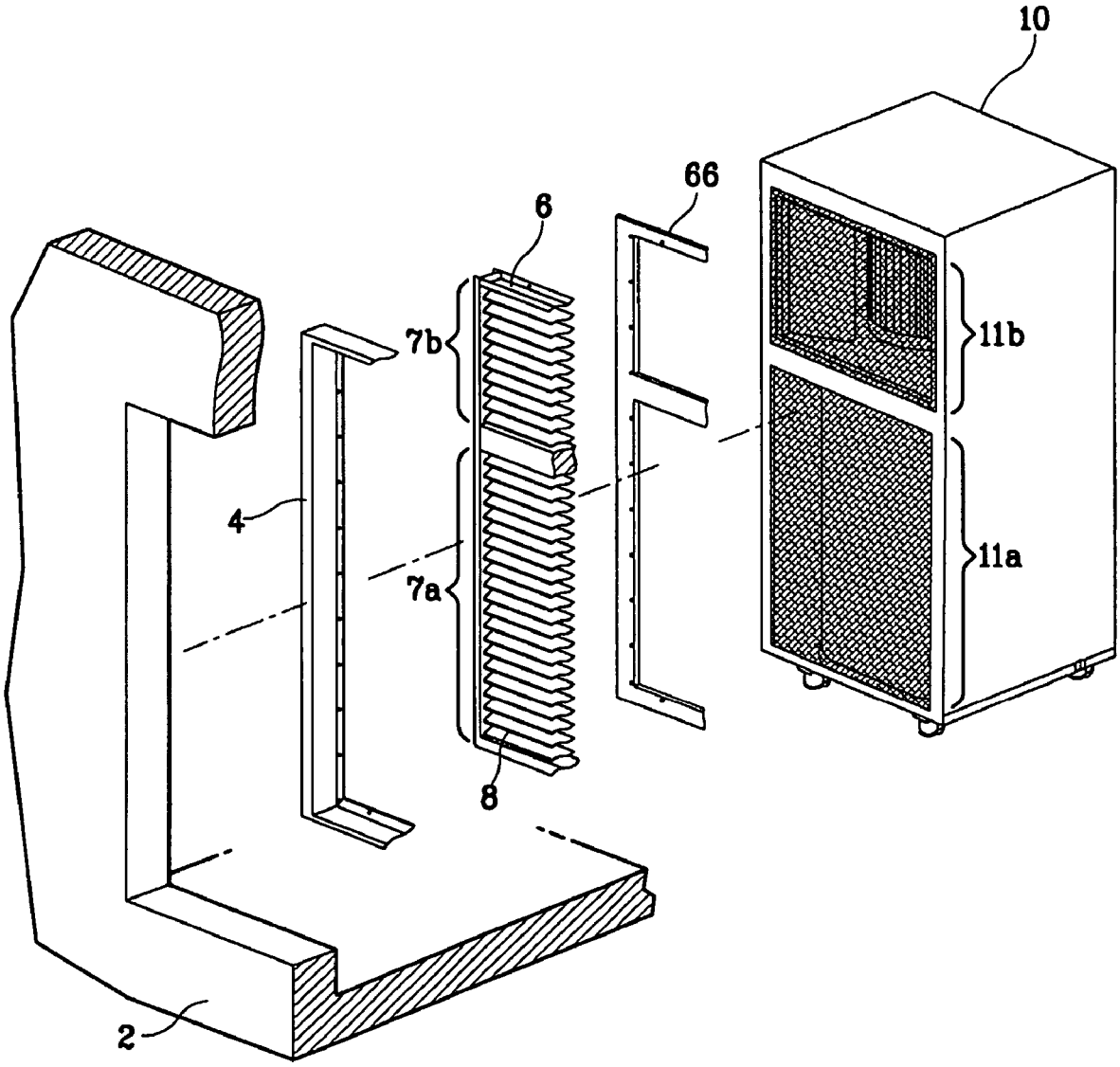
FIG. 2 is an exemplary view illustrating installation and assembly of the outdoor unit of FIG. 1.
Figure 3:
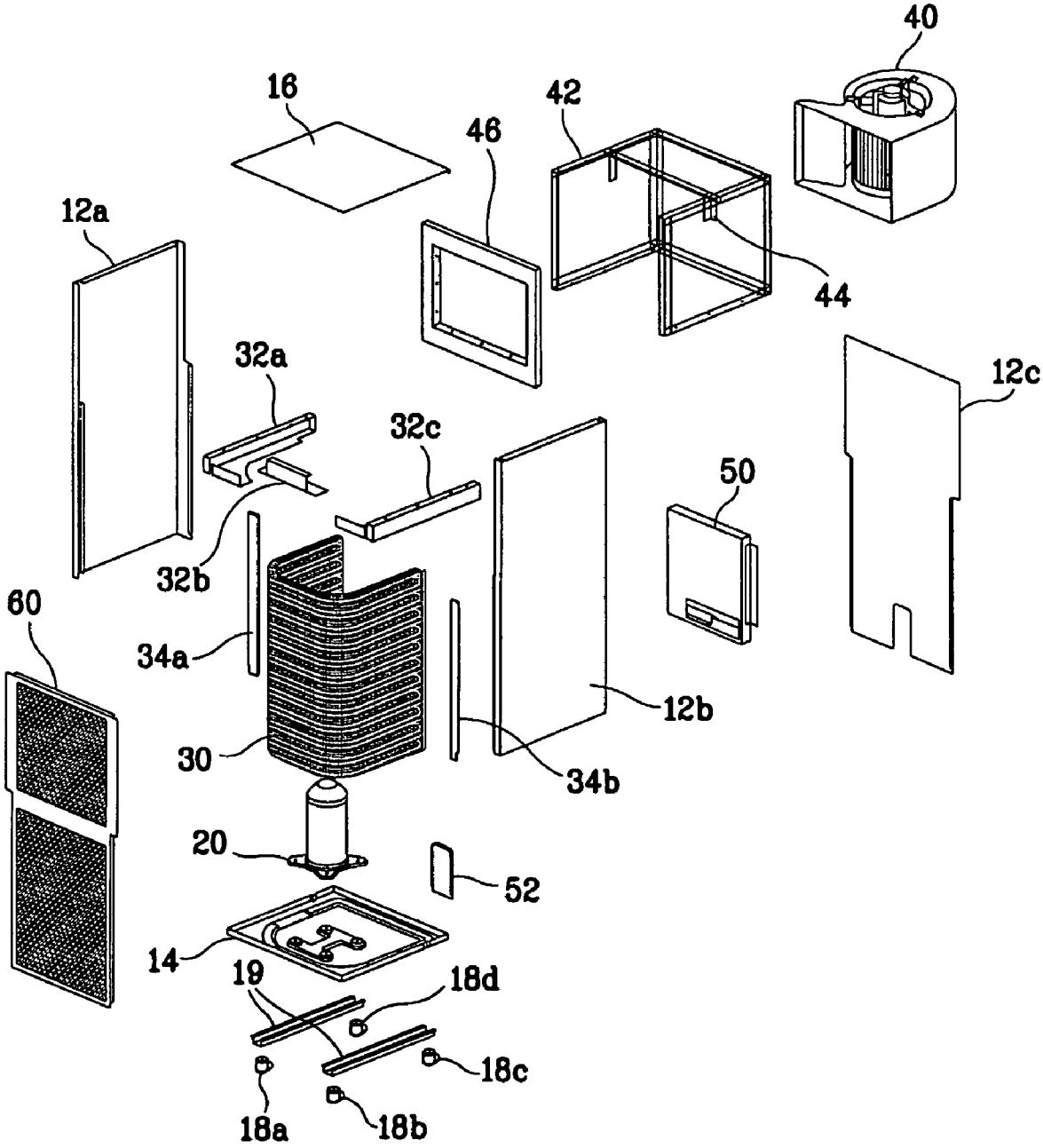
FIG. 3 is a perspective view illustrating disassembly of the outdoor unit of FIG. 1.

FIGS. 1 to 3 are structure views illustrating a front suction/discharge type outdoor unit for an air conditioner in accordance with the preferred embodiment of the present invention.

An external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8.

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades are easily understood by ordinary people skilled in the art to which the present invention pertains. It is also possible to determine the air suction/discharge direction in consideration of an external environment, and to open and maintain the louver blades 8 in a predetermined direction.

On the other hand, the outdoor unit 10 fixedly installed at the inside of the outer wall 2 of the building to contact the external frame 4 and/or internal frame 6 includes an outdoor unit casing composed of components of FIG. 3. In addition, outdoor unit components of FIG. 3 are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, three side covers 12*a*, 12*b* and 12*c*, a bottom cover 14 and a top cover 16 are closed to form a rectangular parallelepiped. The outdoor unit casing can be divided into a suction casing corresponding to the suction unit 11*a* and a discharge casing corresponding to the discharge unit 11*b*. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two legs 18*a* and 18*b* positioned in the forward direction (toward building outer wall) among the leg members 18*a*, 18*b*, 18*c* and 18*d* further include screws (not shown), it is much easier to transport the heavy load outdoor unit 10.

In the suction unit 11*a* of the outdoor unit 10, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by eternally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

Differently from the general outdoor unit sucking external air from three sides and discharging heat exchanged air to a top surface, the front suction/discharge type outdoor unit of the invention restricts its suction area, and thus increases suction resistance in the system. Accordingly, the outdoor unit uses a sirocco cooling fan instead of using an axial fan. That is, in the discharge unit 11*b* of the outdoor unit 10, the sirocco cooling fan 40 for supplying external air to the air-cooled condenser 30 through the suction area 7*a* and discharging heat exchanged air through the discharge area 7*b* is fixedly installed on the side covers 12*a*, 12*b* and 12*c* and the top cover 16 by a fan frame 42 and a fan bracket 44, and also fixedly installed on a fan front 46. Here, horizontal elements on the top and bottom surfaces of the fan frame 42 have 'L' shaped sections, and vertical elements connecting the horizontal elements also have 'L' shaped sections.

Referring to FIGS. 2 and 3, a fan supporting member for fixing the sirocco cooling fan 40 to the outdoor unit casing is required to minimize vibration of fan operation on the system. As shown in FIGS. 2 and 3, the fan supporting member includes the fan frame 42 for reinforcing and supporting the edges of the discharge unit, the fan bracket 44 for fixedly coupling the sides of the sirocco cooling fan 40 to the fan frame 42, and the fan front 46 coupled to the fan frame 42, and also coupled to the sides of the housing of the sirocco cooling fan 40 through which heat exchanged air is discharged, which will later be explained. The fan bracket 44 is formed in various shapes according to the installation direction of the sirocco cooling fan 40. As described above, when the outdoor unit casing is divided into the suction casing corresponding to the suction unit 11*a*, and the discharge casing corresponding to the discharge unit 11*b*, the fan frame 42 reinforces and supports the discharge casing. A control box 50 for controlling the operation of the outdoor unit 10 is installed at the inside of the side cover 12*c* composing the rear surface among the side covers, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

A mesh shaped front grill 60 is additionally installed on the front surface of the outdoor unit 10, namely one opened side facing the suction area 7*a* and the discharge area 7*b* of the internal frame 6 to prevent invasion of animals (for example, rats).

In addition, a plate shape vibration isolating member 66 is adhered to the front grill 60 positioned on the front surface of the outdoor unit casing to absorb vibration of the outdoor unit 10 not to be transmitted to the internal and external frames 4 and 6 and the louver blades 8.

The operation of the front suction/discharge type outdoor unit for the air conditioner will now be explained.

The refrigerant gas inputted from the indoor unit through the refrigerant pipe lines of the valve assembly 52 is compressed in the compressor 20 and supplied to the condenser 30. Because the cooling fan 40 is operated, external air sucked through the gaps between the louver blades 8 of the suction area 7*a* evenly passes through gaps between the fins formed on the three surfaces of the 'U' shaped condenser 30 through the wind path of the condenser covers 32*a*, 32*b* and 32*c* and the condenser brackets 34*a* and 34, increases its temperature by taking condensation heat from the refrigerant gas flowing through the condenser pipe lines inserted between the fins, passes through the cooling fan 40, and is externally discharged through the gaps between the louver blades 8 of the discharge area 7*b*.

Figure 4A:
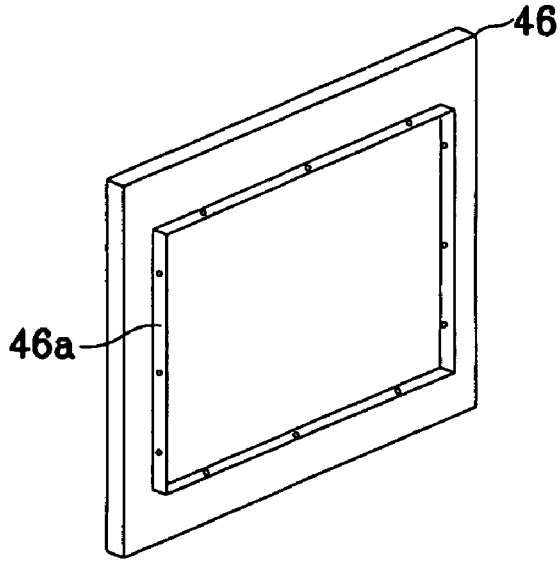
FIGS. 4A to 4C are a rear perspective view illustrating a fan front of FIG. 3, and an assembly view and a cross-sectional view illustrating a fan frame and a sirocco cooling fan of FIG. 3.
Figure 4B:
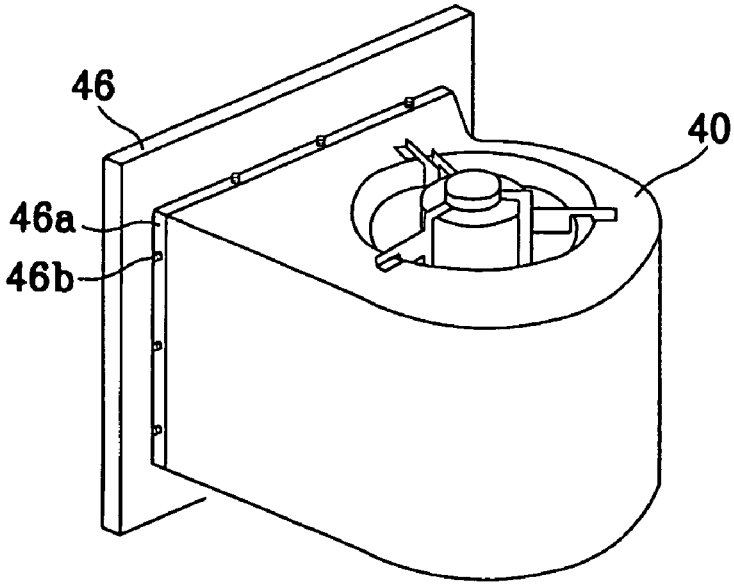
Figure 4C:
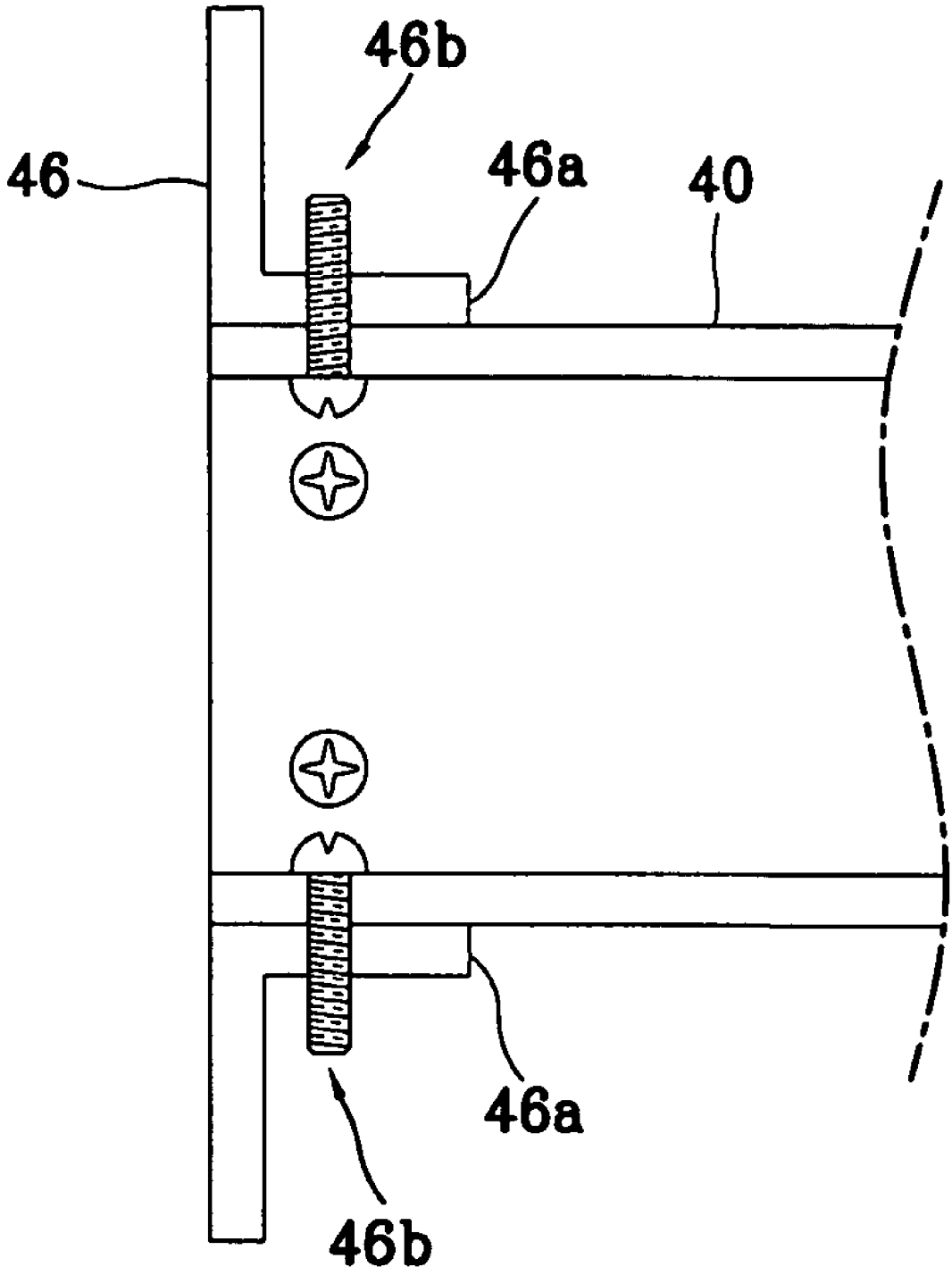

FIGS. 4A to 4C are a rear perspective view illustrating the fan front of FIG. 3, and an assembly view and a cross-sectional view illustrating the fan frame and the sirocco cooling fan of FIG. 3.

FIG. 4A illustrates the fan front 46 including a flange 46*a* facing the inside of the discharge unit 11*b* of the outdoor unit 10, FIG. 4B illustrates an assembly state where a part of the housing of the sirocco cooling fan 40 is inserted and coupled to the flange 46*a*, and FIG. 4C illustrates an assembly state where the flange 46*a* and the part of the housing of the sirocco cooling fan 40 are coupled by coupling members 46*b* (screws in FIG. 4C). Here, nuts (not shown) can be additionally installed at the ends of the coupling members 46*b*. The fan frame 42, the fan front 46 and the sirocco cooling fan 40 can be easily combined by coupling the flange 46*a* to the part of the housing of the sirocco cooling fan 40, which results in high coupling strength.

Figure 5A:
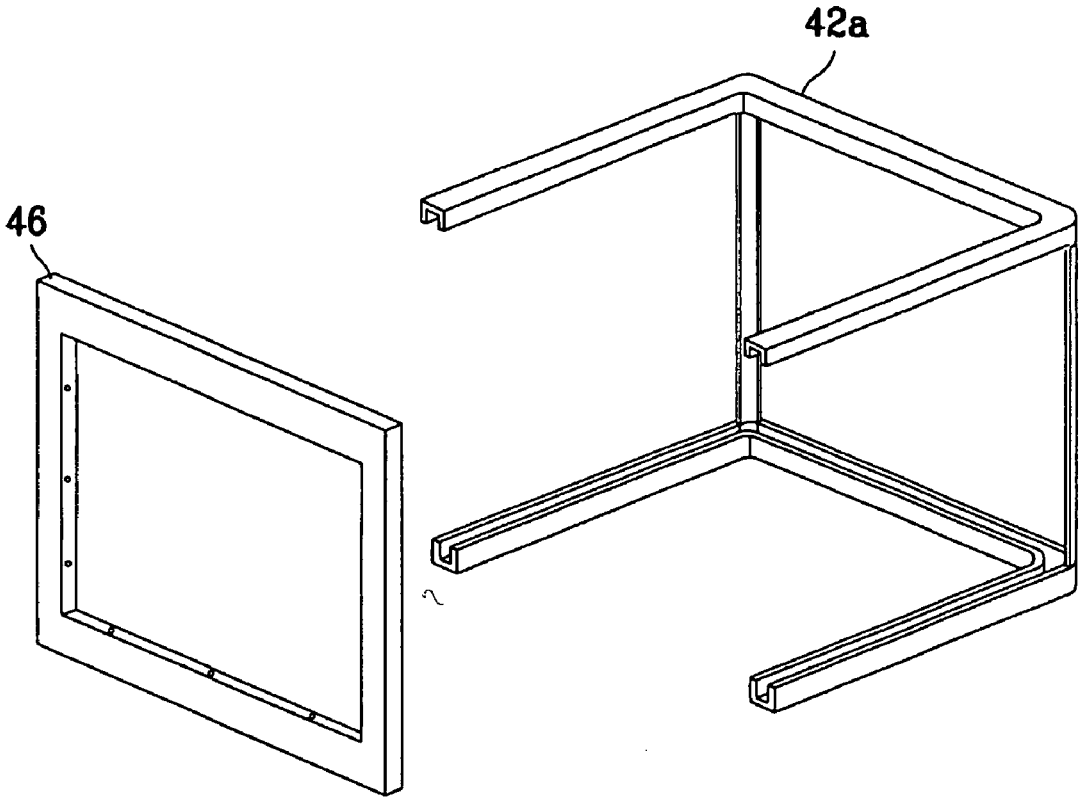
FIGS. 5A to 5C are perspective views illustrating another examples of the fan frame of FIG. 3.
Figure 5B:
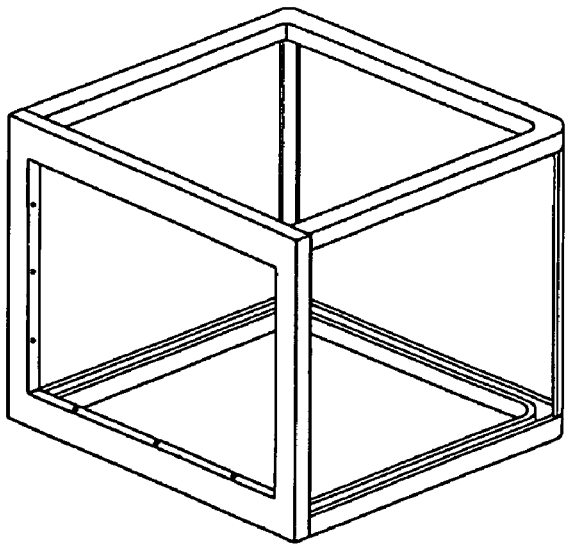
Figure 5C:
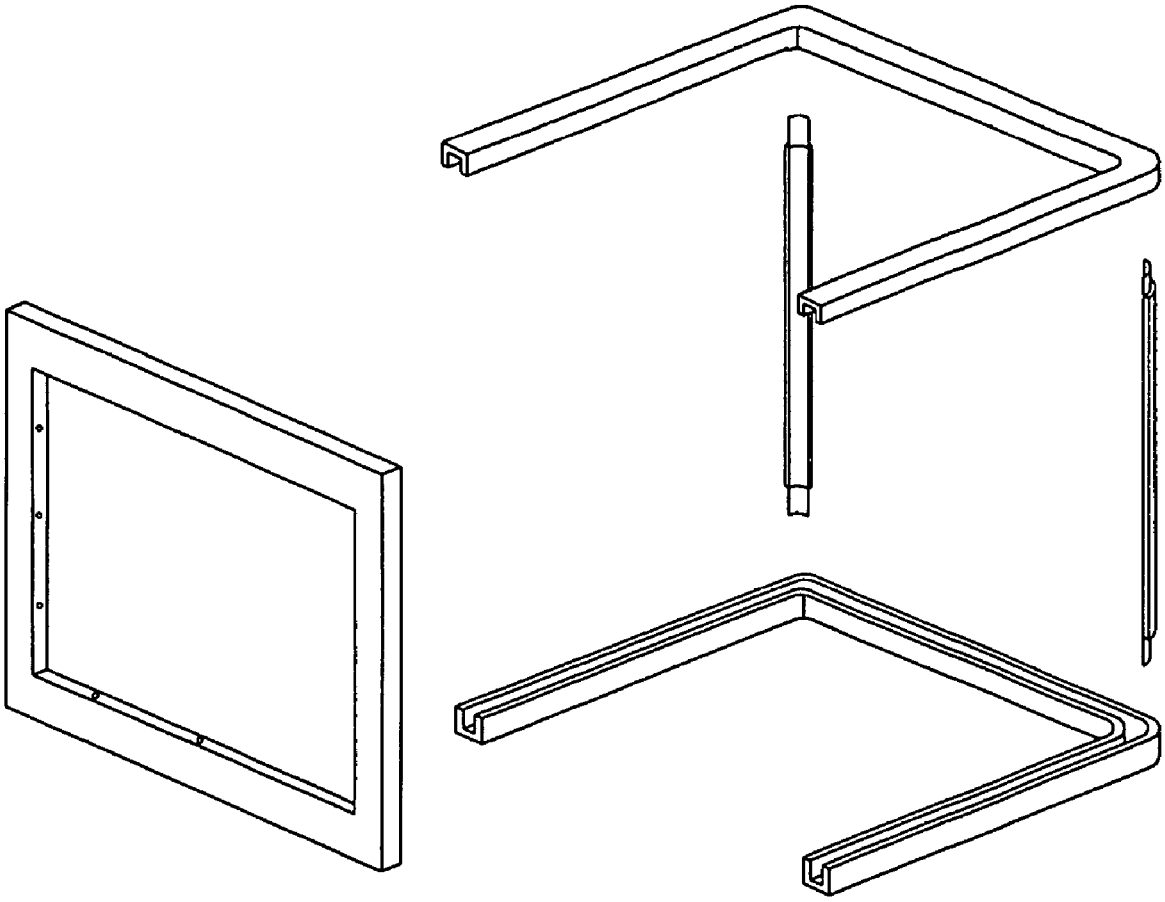

FIGS. 5A to 5C are perspective views illustrating another examples of the fan frame of FIG. 3. As depicted in FIG. 5A, horizontal elements of the fan frame 42*a* have '⊂' shaped sections, and vertical elements thereof have curved surface sections. The fan frame 42*a* can also have different shape sections.

As shown in FIG. 5B, the fan frame 42*a* and the fan front 46 of FIG. 5A can be incorporated, and as shown in FIG. 5C, the fan frame 42*a* can be divided into horizontal and vertical elements. In installation of the outdoor unit 10, such elements can be coupled like the fan frame 42*a* of FIG. 5A or 5B. The fan frame 42*a* divided as described above serves to easily transport and assemble components of the outdoor unit 10 in installation.

Figure 6A:
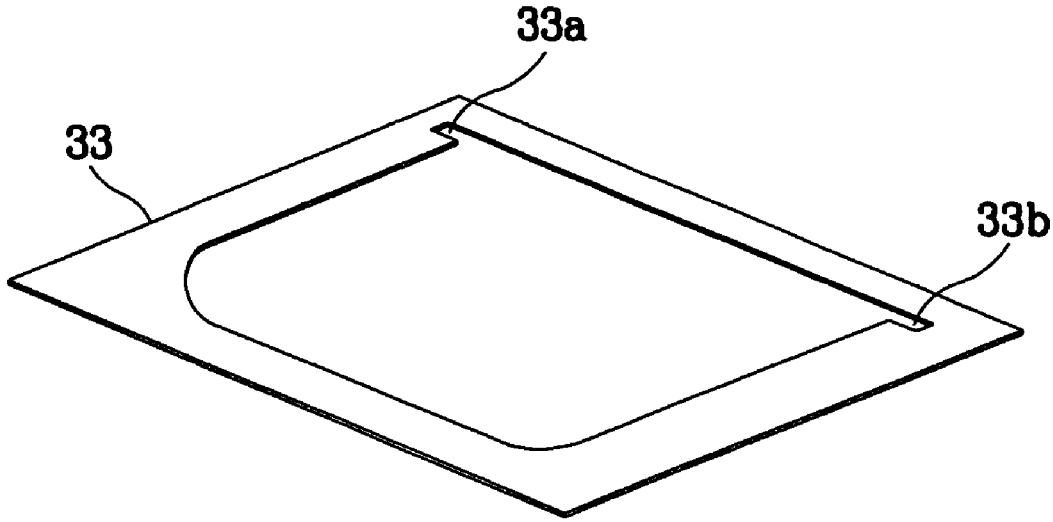
FIGS. 6A to 6G are views illustrating another examples of a condenser cover and fan frame guides of FIG. 3.

FIGS. 6A to 6G are views illustrating another examples of the condenser cover and fan frame guides of FIG. 3. Referring to FIG. 6A, an incorporated condenser cover 33 is used instead of the condenser covers 32*a*, 32*b* and 32*c* having three elements in FIG. 3. Grooves 33*a* and 33*b* are formed on the condenser cover 33 to be coupled to the top ends of the condenser brackets 34*a* and 34*b* of FIG. 3. Identically to the condenser covers 32*a*, 32*b* and 32*c*, the incorporated condenser cover 33 forms a wind path in order for entire external air to pass through the condenser 30, is easily installed, and shows excellent properties in strength.

Figure 6B:
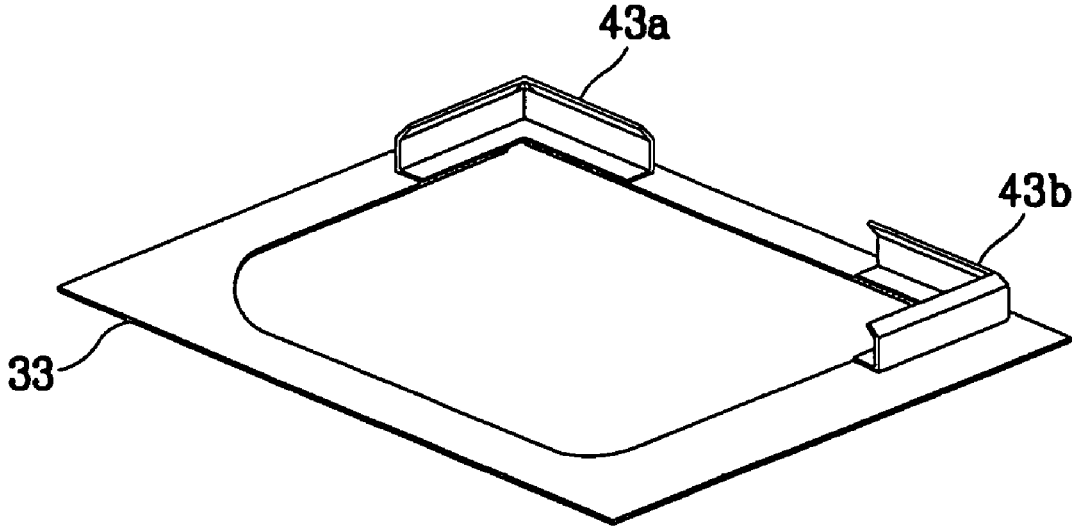

FIG. 6B illustrates the fan frame guides 43*a* and 43*b* having their one sides coupled to the condenser cover 33 of FIG. 6A. When the discharge casing of the outdoor unit 10 reinforced and supported by the fan frame 42*a* is formed, the fan frame guides 43*a* and 43*b* are inwardly inserted into the lower portion of the fan frame 42*a*, for fixing the fan frame 42*a* and/or the discharge casing so as to stably couple the discharge casing to the suction casing. Preferably, one surfaces of the fan frame guides 43*a* and 43*b* are bonded to the condenser cover 33 by spot welding.

Figure 6C:
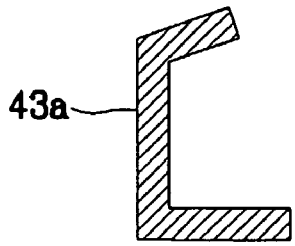

As illustrated in FIG. 6C, the fan frame guides 43*a* and 43*b* of FIG. 6B have surfaces slanted to the center of the condenser 30, namely the inside of the outdoor unit 10. The slanted surfaces serve to stably position the fan frame 42*a* on the condenser cover 33, namely the fan frame guides 43*a* and 43*b*.

Figure 6D:
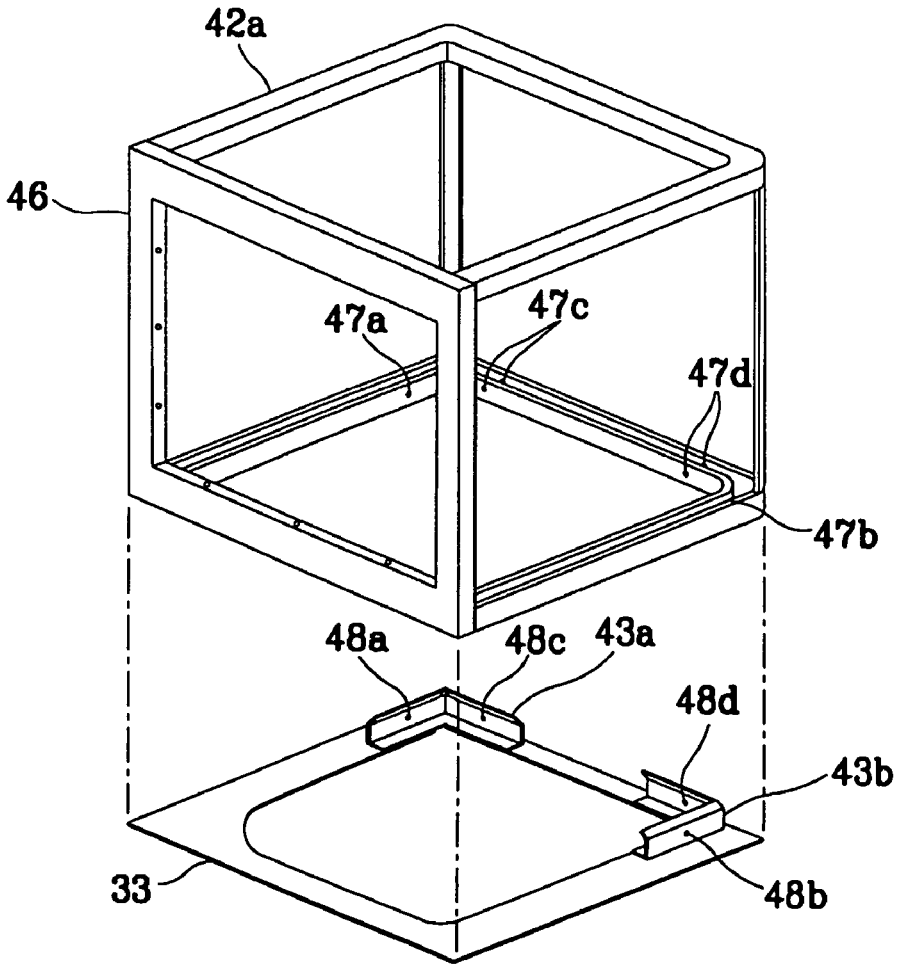

FIG. 6D illustrates an assembly state of the fan frame 42*a* and the condenser cover 33. Both edges of the rear surface of the fan frame 42*a* are coupled to the curved surfaces of the fan frame guides 43*a* and 43*b*, for easily precisely positioning the fan frame 42*a* on the condenser cover 33. In addition, both sides of the bottom surface of the fan frame 42*a* facing the surfaces contacting one opened surface have openings 47*a* and 47*b* passing through the insides thereof, and the side of the bottom surface of the fan frame 42*a* facing the side 12*c* which is the rear surface of the outdoor unit 10 has openings 47*c* and 47*d* passing through the inside and outside thereof. Therefore, openings 48*a* and 48*b* are formed on the fan frame guides 43*a* and 43*b* to correspond to the openings 47*a* and 47*b* of the fan frame 42*a*, and openings 48*c* and 48*d* are formed on the fan frame guides 43*a* and 43*b* to correspond to the openings 47*c* and 47*d* of the fan frame 42*a*.

Figure 6E:
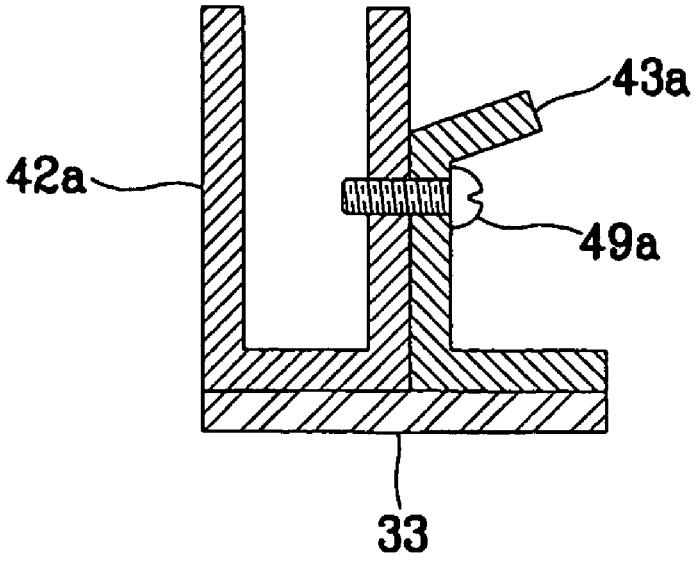

FIG. 6E is a cross-sectional view illustrating an assembly state of both sides of the bottom surface of the fan frame 42*a* facing the surfaces contacting one opened surface and the fan frame guides 43*a* and 43*b* of FIG. 6D. The opening 48*a* of the fan frame guide 43*a* bonded to the condenser cover 33 is coupled to the opening 47*a* of the fan frame 42*a* by a screw 49*a*. In detail, the screw 49*a* is inserted from the inside of the outdoor unit 10 into the outside, for coupling the fan frame 42*a* to the fan frame guide 43*a*. Accordingly, the fan frame 42*a* for supporting the sirocco cooling fan 40 is fixed to the discharge casing. Preferably, a nut (not shown) for fixing the screw 49*a* can be additionally installed at the edge of the screw 49*a*.

Figure 6F:
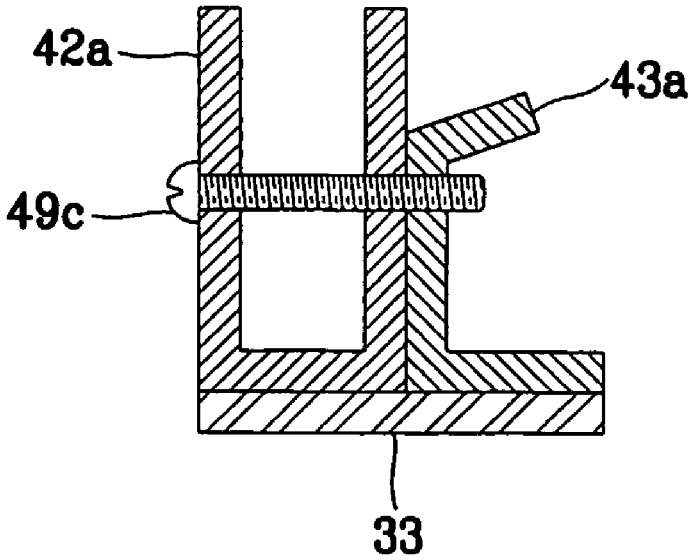

Conversely, FIG. 6F is a cross-sectional view illustrating an assembly state of the side of the bottom surface of the fan frame 42*a* facing the side 12*c* which is the rear surface of the outdoor unit 10 and the fan frame guides 43*a* and 43*b*. The opening 48*c* of the fan frame guide 43*a* bonded to the condenser cover 33 is coupled to the opening 47*c* of the fan frame 42*a* by a screw 49*c*. In detail, the screw 49*c* is inserted from the outside of the outdoor unit 10 into the inside, for coupling the fan frame 42*a* to the fan frame guide 43*a*. Thus, the fan frame 42*a* for supporting the sirocco cooling fan 40 is fixed to the discharge casing. Preferably, a nut (not shown) for fixing the screw 49*c* can be additionally installed at the edge of the screw 49*a*.

Figure 6G:
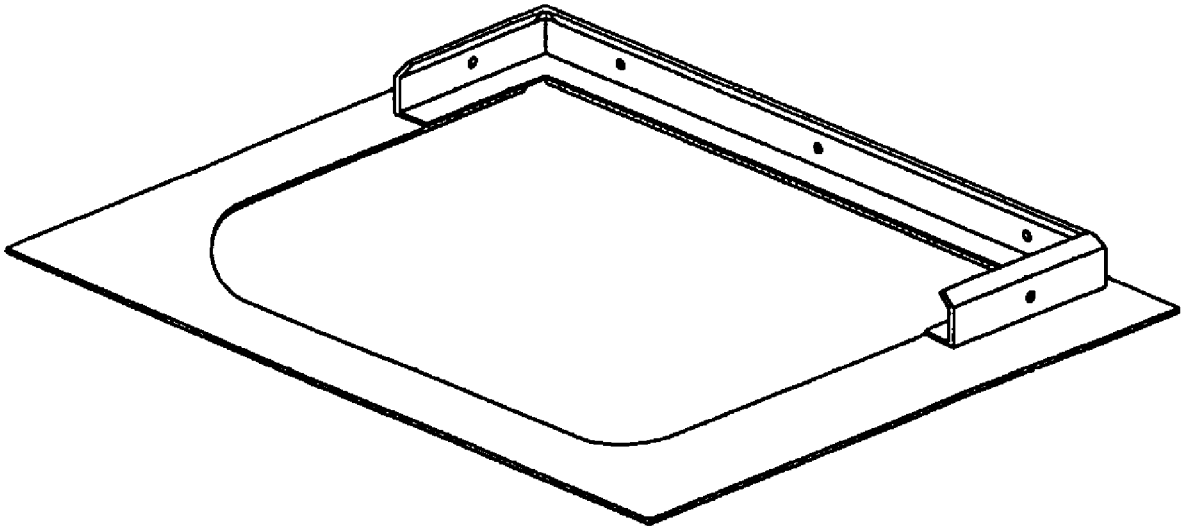

FIG. 6G shows a different shaped fan frame guide 43*c*. The fan frame guide 43 is incorporated to be easily installed, and provides excellent properties in strength.

Figure 7A:
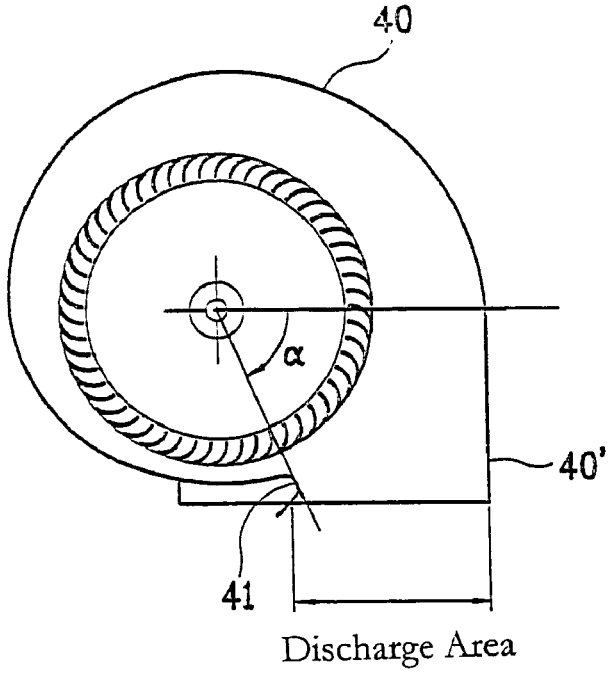
FIGS. 7A and 7B are structure views illustrating a diffuser of a sirocco cooling fan installed in a discharge unit of the outdoor unit in accordance with the present invention.
Figure 7B:
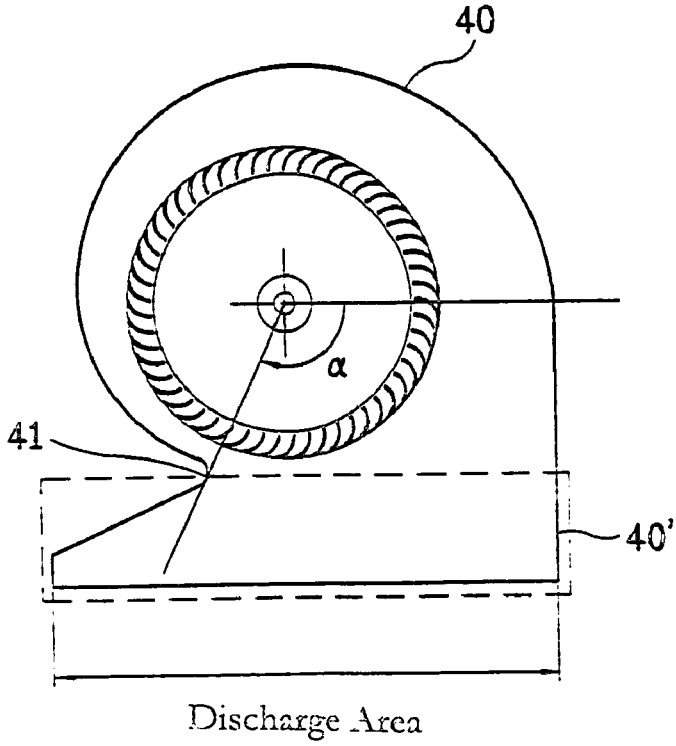

FIGS. 7A and 7B are structure views illustrating a diffuser of the sirocco cooling fan installed in the discharge unit of the outdoor unit in accordance with the present invention. The diffuser 40' of the sirocco cooling fan 40 has a structure shown in FIG. 7B. That is, FIGS. 7A and 7B show a cutoff angle α of a cutoff 41 of the diffuser 40'. When the cutoff angle α of the cutoff 41 is smaller than 90° as shown in FIG. 7A, the diffuser 40' is operated as discharge resistance and a discharge area decreases, but when the cutoff angle α is greater than 90° as shown in FIG. 7B, the diffuser 40' is not operated as discharge resistance, the discharge area increases, a flow rate of the fan discharge unit compared with the same air volume decreases, and resistance by the mesh of the front grill 60 also decreases, to increase air volume.

FIGS. 8A to 8F are views illustrating installation examples of the sirocco cooling fan in the discharge unit of the outdoor unit of FIG. 1. The sides 12*a*, 12*b* and 12*c* are omitted for explanations.

Figure 8A:
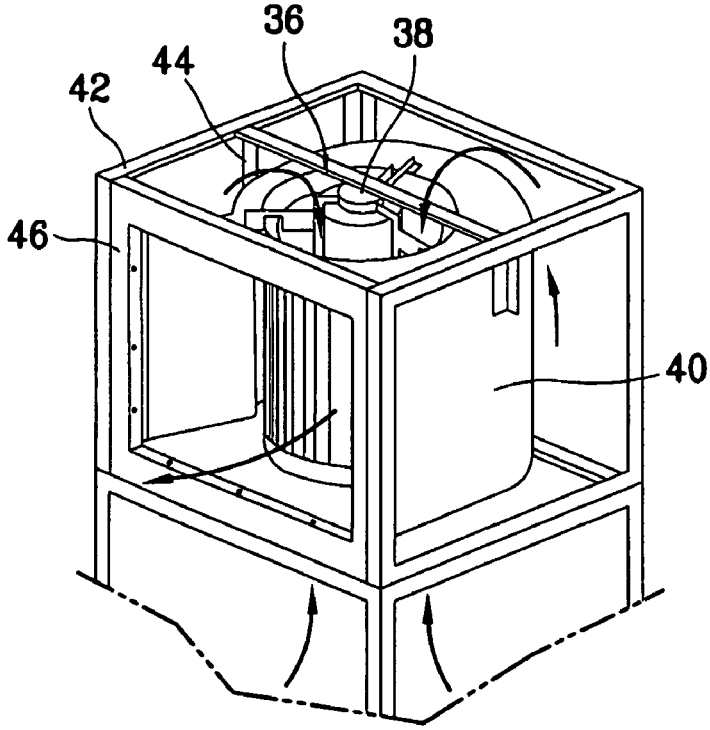
FIGS. 8A to 8F are views illustrating installation examples of the sirocco cooling fan in the discharge unit of the outdoor unit of FIG. 1.

Referring to FIG. 8A, one of suction orifices 36 of the sirocco cooling fan 40 faces the surface contacting the opened surface of the outdoor unit 10 and being farthest from the suction unit of the outdoor unit 10, and the other orifice faces the suction unit, namely the top cover 16. Arrows of FIG. 8A indicate suction directions of air through the suction orifices 36. As shown in FIG. 8A, most of air is sucked through the lower orifice 36, and relatively small air is sucked through the orifice 36 facing the top cover 16. In this case, a motor 38 for driving the sirocco cooling fan 40 is installed adjacently to the up direction orifice 36 below the top cover 16 not to be operated as suction resistance.

As described above, the fan frame 42 for reinforcing and supporting the edges of the discharge unit and the fan bracket 44 for fixedly coupling the two surfaces of the sirocco cooling fan 40 to the fan frame 42 are used to fix the sirocco cooling fan 40 to the outdoor unit casing.

Figure 8B:
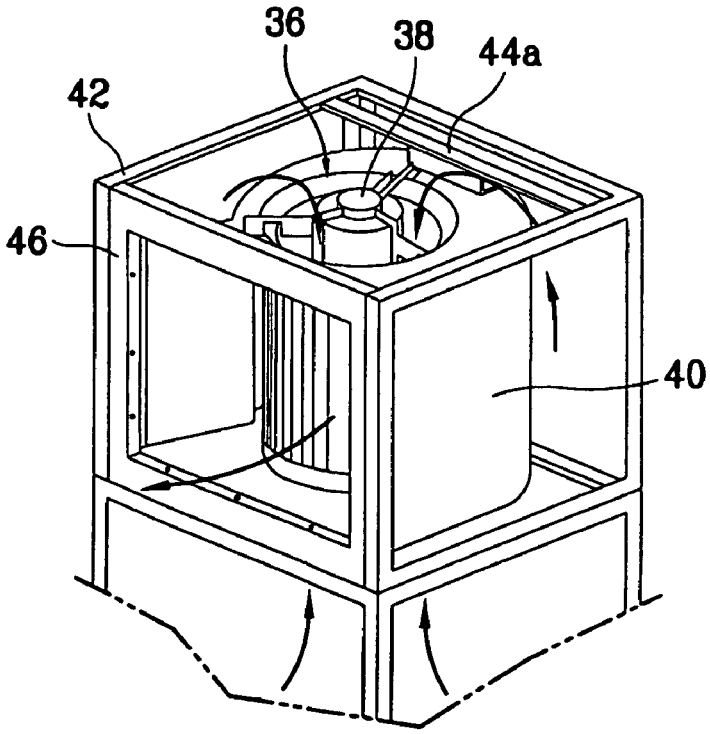

FIG. 8B illustrates a fan bracket 44*a* having a different shape from the fan bracket 44 of FIG. 8A. The fan bracket 44*a* fixedly couples one of the surfaces of the housing of the sirocco cooling fan 40 on which the suction orifices 36 are positioned to the fan frame 42.

Figure 8C:
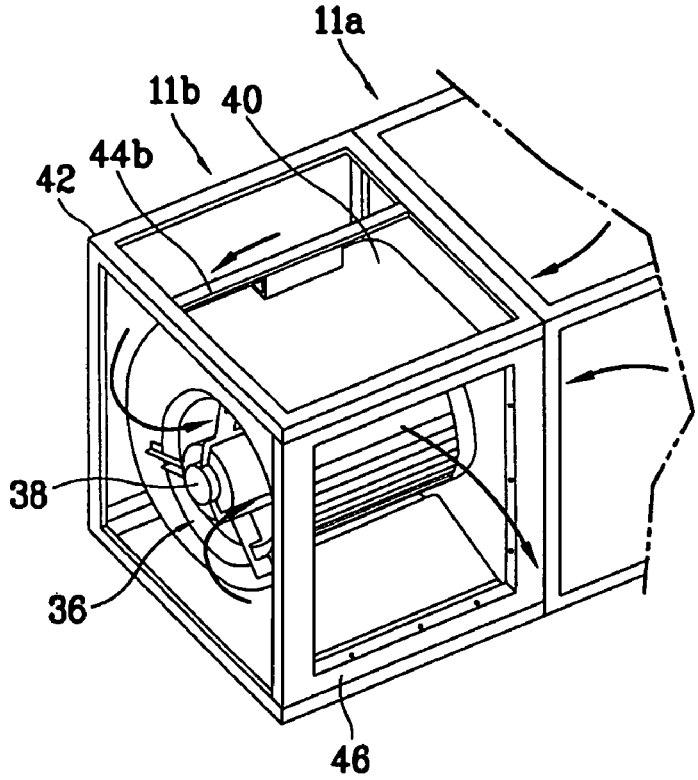

FIG. 8C shows an example of the outdoor unit where the suction unit 11*a* and the discharge unit 11*b* do not compose the up/down structure but the right/left structure. Here, air heat exchanged in the right side suction unit 11*a* is discharged through the left side discharge unit 11*b*. In this case, a fan bracket 44*b* for fixedly coupling one surface of the casing of the sirocco cooling fan 40 to the fan frame 42 can be used. That is, the constitution and structure of the fan bracket 44 is varied according to the installation direction of the sirocco cooling fan 40.

Figure 8D:
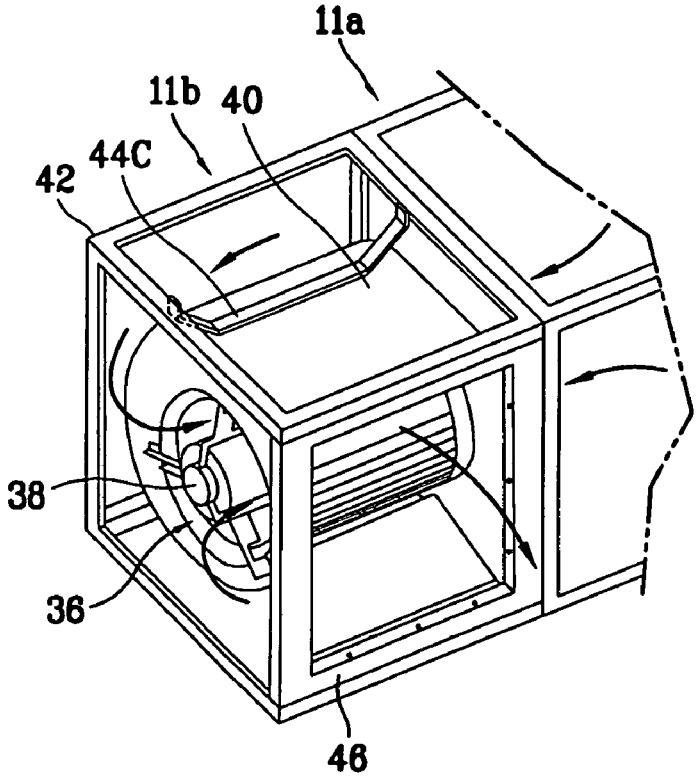

FIG. 8D illustrates another example of the fan bracket 44*b* of FIG. 8C. The fan bracket 44*b* of FIG. 8C is composed of two or more elements, but a fan bracket 44*c* of FIG. 8D is composed of one element. Accordingly, it can be easily installed, and provide excellent properties in strength. The fan bracket 44 can be formed in various types.

Figure 8E:
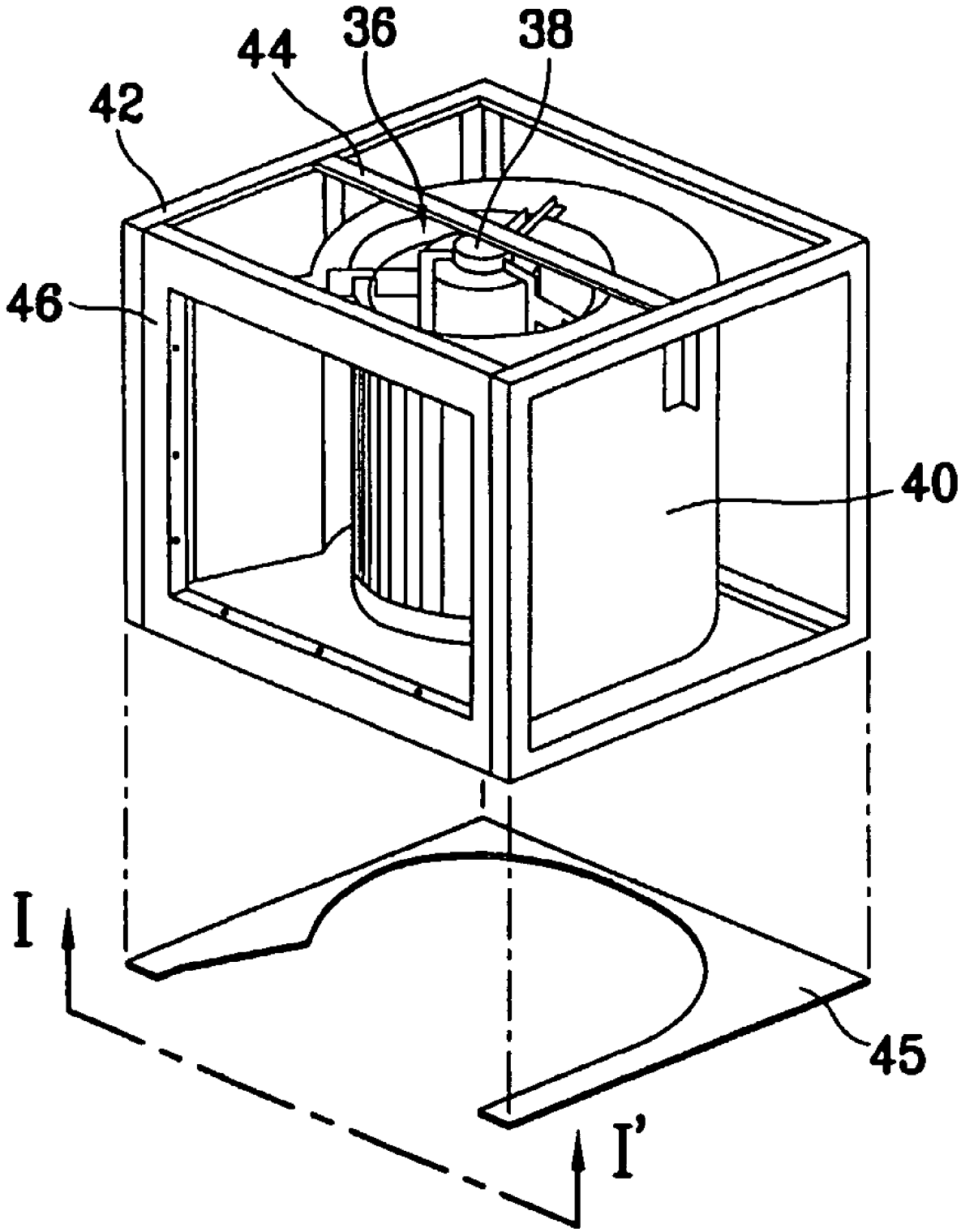

FIG. 8E depicts the outdoor unit 10 additionally having a dividing plate 45 for intercepting relatively small air sucked through the orifice 36 facing the top cover 16 as shown in FIG. 8A. That is, the dividing plate 45 intercepts the gaps between the sirocco cooling fan 40 (or cooling fan housing) and the fan frame 42 (or side covers 12*a*, 12*b* and 12*c* of outdoor unit casing), so that external air passing through the condenser 30 can be all sucked through the orifice facing the suction casing (lower orifice 36 of cooling fan 40) and discharged through one opened surface.

Figure 8F:
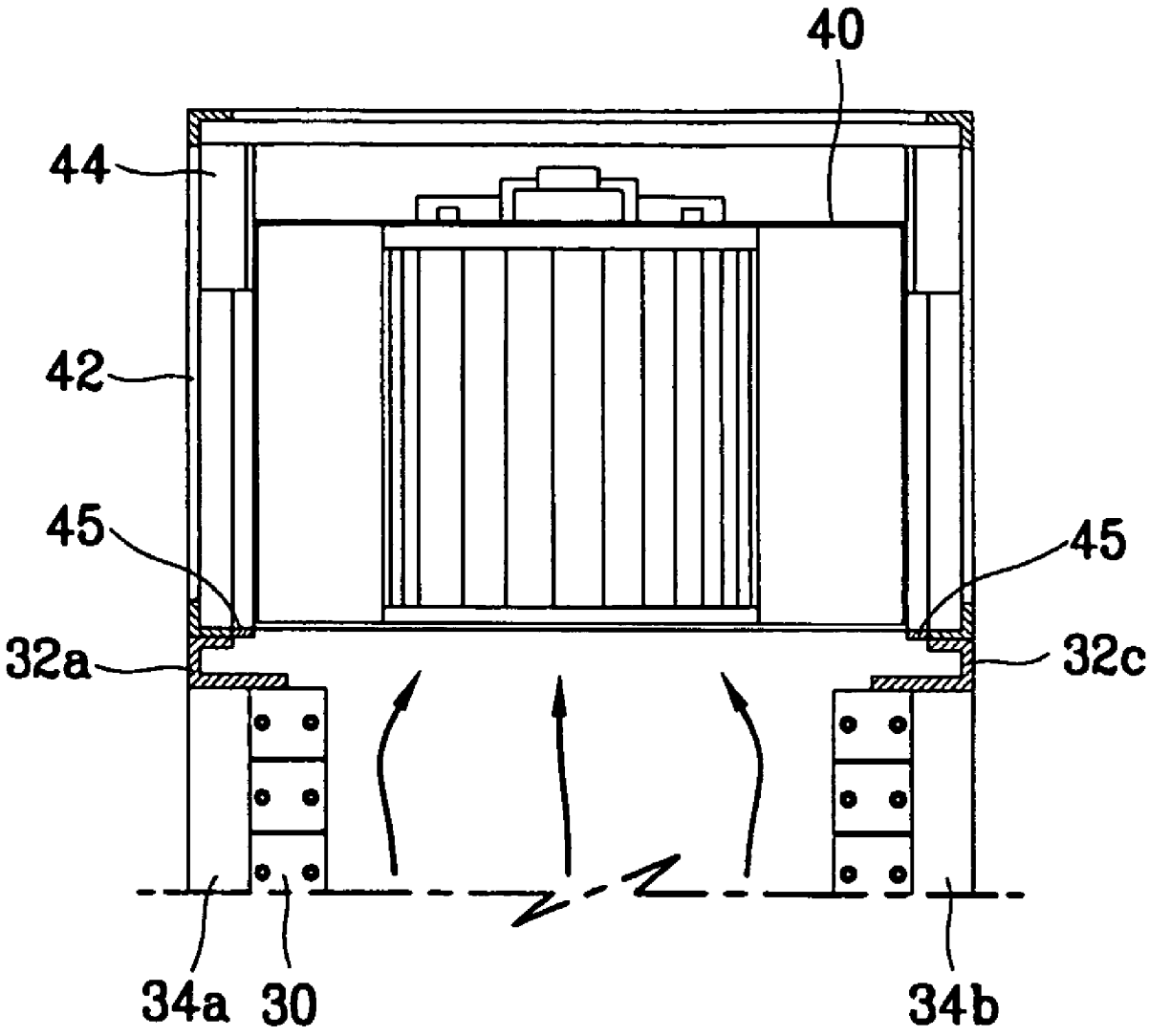

FIG. 8F is a cross-sectional view taken along line I-I' of FIG. 8E. In detail, FIG. 8F shows a process for sucking entire air passing through the air-cooled condenser through the lower orifice 36 of the sirocco cooling fan 40 in an arrow direction by the induction of the dividing plate 45. Heat exchange efficiency of the outdoor unit can be improved, and the sirocco cooling fan 40, especially the motor 38 is prevented from being heated due to contact with heat exchanged air, by rapidly externally discharging heat exchanged air passing through the air-cooled condenser 30 by the dividing plate 45.

FIGS. 9A to 9D are views illustrating another installation examples of the sirocco cooling fan in the discharge unit of the outdoor unit of FIG. 1. The sides 12*a*, 12*b* and 12*c* are omitted for explanations.

Figure 9A:
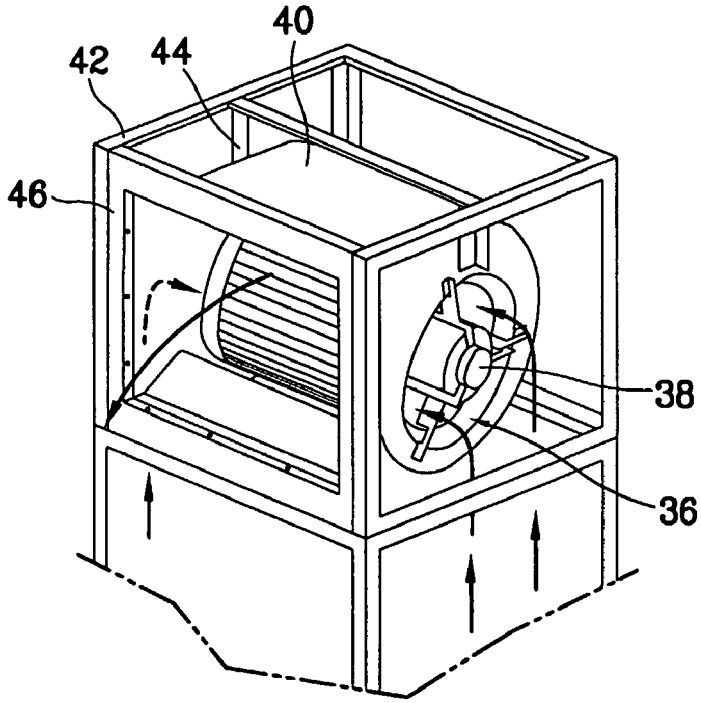
FIGS. 9A to 9D are views illustrating another installation examples of the sirocco cooling fan in the discharge unit of the outdoor unit of FIG. 1.

Referring to FIG. 9A, the suction orifices 36 of the sirocco cooling fan 40 face the two surfaces contacting the opened surface of the outdoor unit 10, namely the side covers 12*a* and 12*b*. Arrows of FIG. 9A indicate suction directions of air through the suction orifices 36.

As described above, the fan frame 42 for reinforcing and supporting the edges of the discharge unit and the fan bracket 44 for fixedly coupling the two surfaces of the sirocco cooling fan 40 to the fan frame 42 are used to fix the sirocco cooling fan 40 to the outdoor unit casing.

Figure 9B:
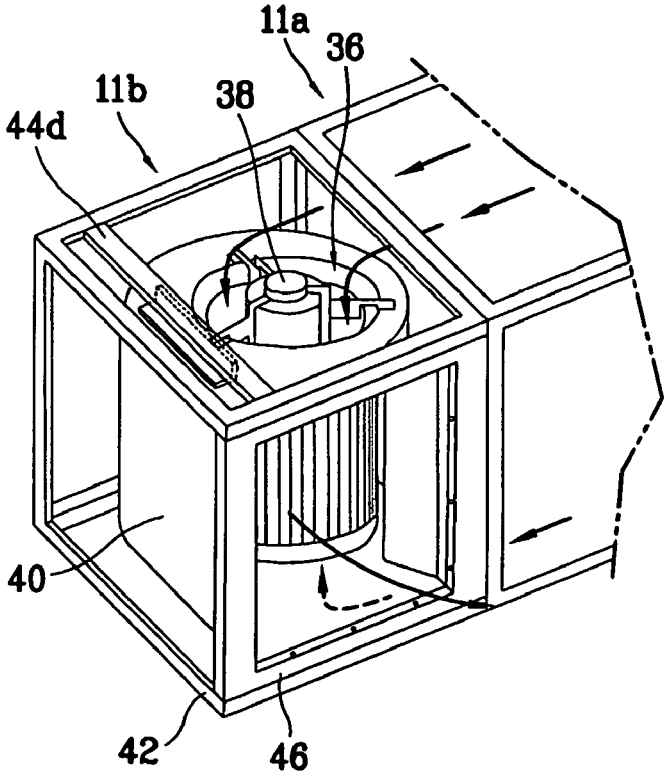

FIG. 9B shows an example of the outdoor unit where the suction unit 11*a* and the discharge unit 11*b* do not compose the up/down structure but the right/left structure. Here, air heat exchanged in the right side suction unit 11*a* is discharged through the left side discharge unit 11*b*. In this case, a fan bracket 44*d* for fixedly coupling one surface of the casing of the sirocco cooling fan 40 to the fan frame 42 can be used. That is, the constitution and structure of the fan bracket 44 is varied according to the installation direction of the sirocco cooling fan 40.

The structures of FIGS. 9A and 9B increase suction resistance of air sucked from the suction unit 11*b* more than the structures of FIGS. 8A to 8D due to alignment of the sirocco cooling fan 40. Because the motor 38 is operated as suction resistance, air sucked to the orifice 36 which the motor is installed on is relatively reduced. The structure which can solve the foregoing problems will now be explained.

Figure 9C:
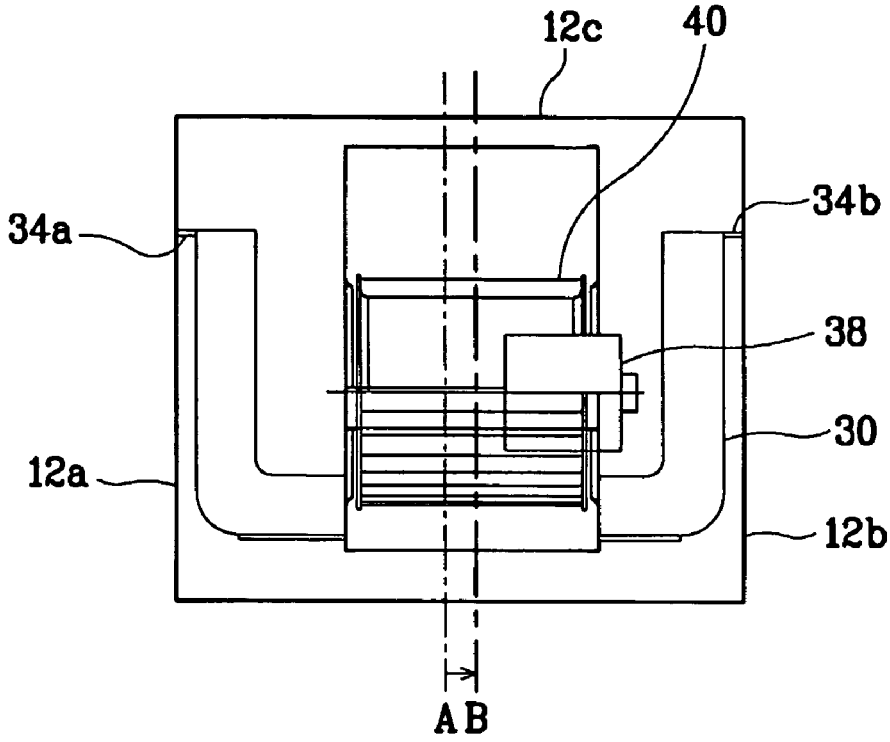

As illustrated in FIG. 9C, in order to overcome eccentricity of load, a central line B of the motor 38 of the sirocco cooling fan 40 is eccentrically installed to the side where the motor has been installed 38 on a central line A of the air-cooled condenser 30. Therefore, air sucked from both sides of the condenser 30 is not eccentric but uniform. As a result, heat exchange efficiency and heating and cooling efficiency can remarkably improve.

Figure 9D:
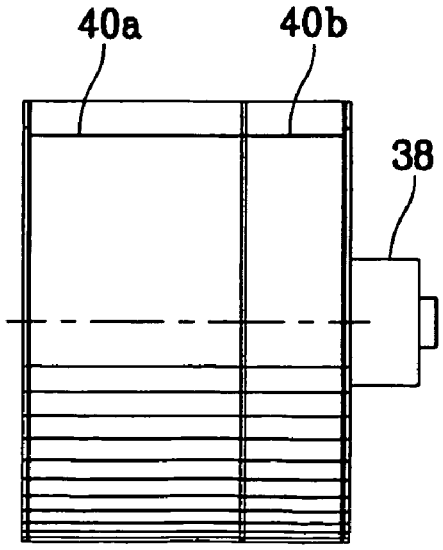

In addition, as shown in FIG. 9D, in order to overcome eccentricity of load, a width of fan blades in the side where the motor 38 is installed is smaller than that of fan blades in the opposite side. That is, the width of both blades is eccentric. Accordingly, eccentricity of load that smaller air is sucked to the orifice 36 of the motor mounted part than the opposite side orifice 36 is overcome, air volume increases, and thus heat exchange efficiency and heating and cooling efficiency improve.

Figure 10A:
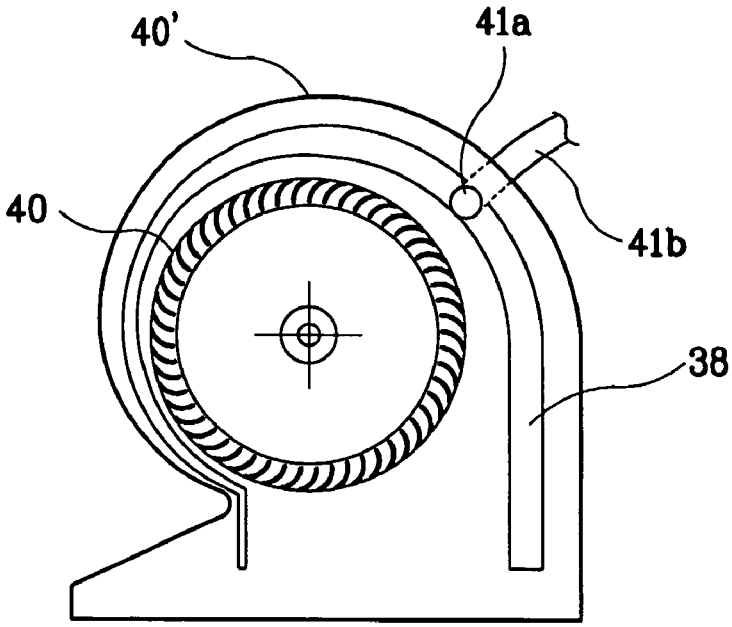
FIGS. 10A and 10B are schematic views illustrating a drainage structure of the cooling fan of the outdoor unit of FIG. 1.
Figure 10B:
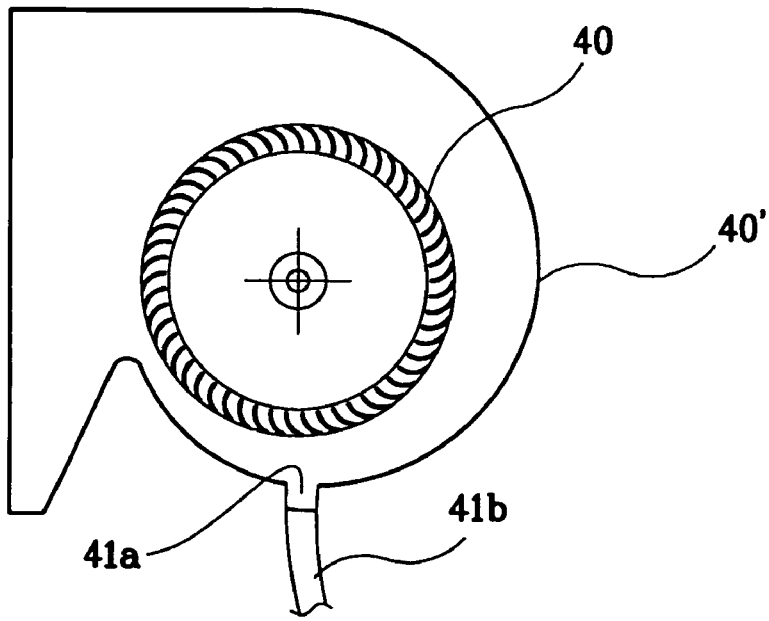

FIGS. 10A and 10B are schematic views illustrating a drainage structure of the cooling fan of the outdoor unit of FIG. 1.

When it is rainy and windy like a typhoon, rain drops may be leaked to the front suction/discharge type outdoor unit for the air conditioner. Especially, when rain drops are leaked to the housing of the fan, water stays in the housing, to cause noise and reduce ventilation capability. In accordance with the present invention, the drainage structure for discharging eternally-inputted water such as rain drops is installed in the housing.

FIG. 10A illustrates a drainage structure when the suction orifices 36 of the sirocco cooling fan 40 face the up/down direction as shown in FIGS. 8A and 9B. Here, the fan housing 40' includes a drainage caved-in unit 38 on its bottom unit. The caved-in unit 38 is slanted and has a drainage hole on its lowest surface. Thus, water inputted to the fan housing 40' is discharged through a drainage hose 41*b* connected to the drainage hole 41*a*.

FIG. 10B shows a drainage structure when the suction orifices 36 of the sirocco cooling fan 40 are installed in the right/left direction as shown in FIGS. 8C, 8D and 9A. Here, a fan housing 40' has a bottom unit. The bottom unit is slanted and has a drainage hole 41*a* on its lowest surface. Therefore, water inputted to the fan housing 40' is discharged through a drainage hose 41*b* connected to the drainage hole 41*a*.

Figure 11:
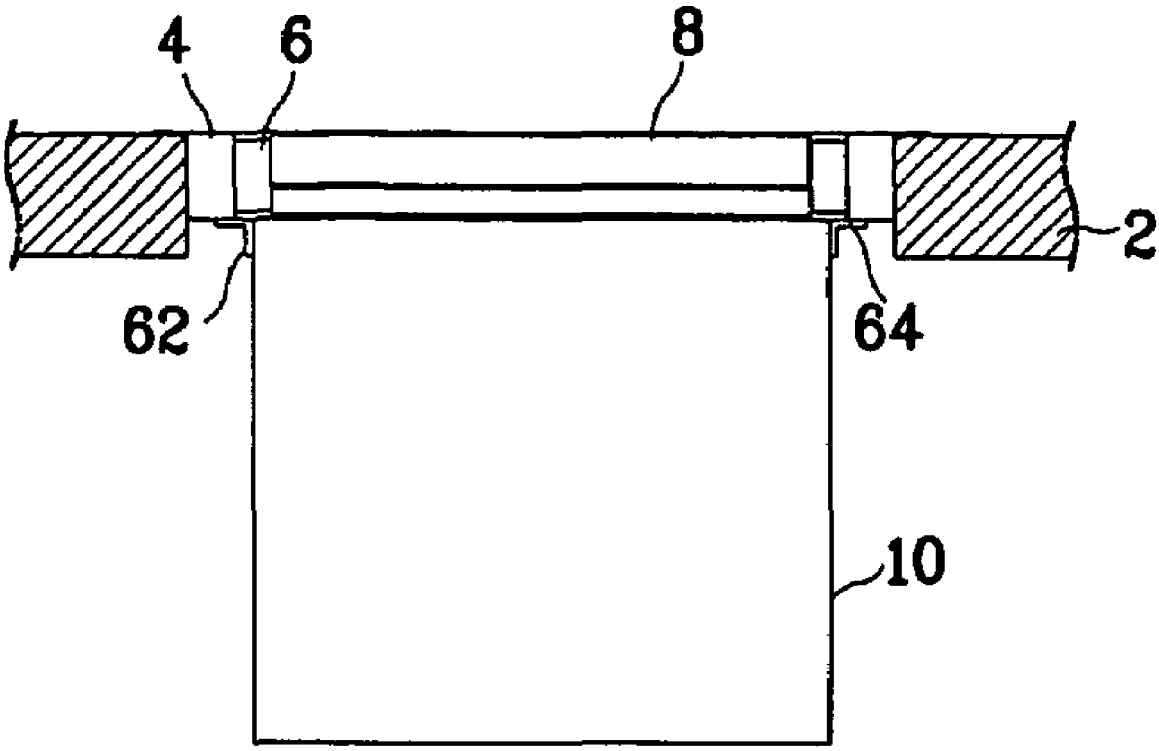
FIG. 11 is a plan view illustrating mounted constitution of the outdoor unit of FIG. 1.

FIG. 11 is a plan view illustrating mounted constitution of the outdoor unit of FIG. 1. As depicted in FIG. 11, a width of the outdoor unit 10 is smaller than that of the internal space of the external frame 4 fixedly installed at the inside of the outer wall, and thus a special fastening member, for example an 'L' shaped bracket 62 is used to fix the outdoor unit 10 to the external frame 4 and the side covers 12*a* and 12*b*. In this case, the outdoor unit 10 is not fixed to the concrete outer wall 2, and thus is easily fixedly installed. In addition, a gap exists between the concrete outer wall 2 and the outdoor unit 10 as large as the external frame 4, and thus the outdoor unit 10 is easily fixedly installed. Moreover, a plate shape sealing member 64 is inserted between the internal frame 6 and the outdoor unit casing, so that external air sucked through the suction area 7*a* can pass through the suction unit 11*a* without being leaked to other spaces (for example, discharge unit 11*b*), and that air discharged from the discharge unit 11*b* can be externally discharged through the discharge area 7*b* without being leaked to other spaces (for example, suction unit 11*a*). A plate shape vibration isolating member 66 is inserted into the front grill 60 positioned on the front surface of the outdoor unit casing so that the outdoor unit 10 can absorb vibration of the cooling fan 40.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A built-in type compressor and condenser unit for an air conditioner, comprising:

a compressor and condenser unit casing being formed in a rectangular parallelepiped shape, and having one opened surface facing a suction area and a discharge area and having its other surfaces closed, and being divided into a suction unit and a discharge unit corresponding to the suction area and the discharge area;

a compressor installed in the casing, for compressing a refrigerant gas supplied from an indoor unit through pipe lines;

an air-cooled condenser installed in the suction unit of the casing, for condensing the refrigerant gas from the compressor; and a sirocco cooling fan installed in the discharge unit of the casing, for supplying external air to the air-cooled condenser through the suction area, and discharging heat exchanged air through the discharge area.

2. The compressor and condenser unit of claim 1, wherein the sirocco cooling fan comprises a diffuser having a cutoff angle of at least 90°.

3. The compressor and condenser unit of claim 1, wherein one suction orifice of the sirocco cooling fan faces the surface of the unit casing contacting the one opened surface facing the discharge area and being farthest from the suction unit among the other surfaces, and the other orifice faces the suction unit.

4. The compressor and condenser unit of claim 3, wherein a motor of the sirocco cooling fan is positioned adjacent the suction orifice below the surface of the compressor and condenser unit casing.

5. The compressor and condenser unit of claim 4, further comprising a dividing plate for intercepting gaps between the cooling fan and the inside surface of the compressor and condenser unit casing so that external air from the suction unit can be sucked through the suction orifice of the sirocco cooling fan facing the air-cooled condenser and discharged.

6. The compressor and condenser unit of claim 3, wherein the housing of the sirocco cooling fan comprises a drainage structure.

7. The compressor and condenser unit of claim 6, wherein the drainage structure comprises a drainage caved-in unit formed on the bottom of the housing, a drainage hole formed on the lowest surface of the caved-in unit, and a drainage hose extended from the drainage hole.

8. The compressor and condenser unit of claim 6, wherein the drainage structure comprises a drainage hole formed on the lowest surface of the housing, and a drainage hose extended from the drainage hole.

9. The compressor and condenser unit of claim 1, wherein suction orifices of the sirocco cooling fan face two surfaces of the unit casing contacting the one opened surface facing the discharge area.

10. The compressor and condenser unit of claim 9, wherein the motor of the sirocco cooling fan is installed adjacent the suction orifice facing one of the two surfaces, and a width of fan blades in the side where the motor is installed is smaller than that of fan blades in the opposite side.

11. The compressor and condenser unit of claim 9, wherein the motor of the sirocco cooling fan is installed adjacent the suction orifice facing one side of the two surfaces, and the sirocco cooling fan is installed eccentrically to a side where the motor has been installed on a central line of the air-cooled condenser.

12. The compressor and condenser unit of claim 1, wherein the discharge unit of the compressor and condenser unit casing further comprises a fan supporting member for supporting the cooling fan.

13. The compressor and condenser unit of claim 12, wherein the supporting member comprises a fan frame for reinforcing and supporting the edges of the discharge unit, and a fan bracket for fixedly coupling at least one surface of a housing of the sirocco cooling fan to the fan frame.

14. The compressor and condenser unit of claim 13, wherein the fan frame comprises a flange unit facing the inside of the discharge unit and contacting the housing of the sirocco cooling fan on the surface contacting one opened surface.

15. The compressor and condenser unit of claim 14, further comprising a coupling member for fixing the flange to the housing of the sirocco cooling fan.

16. The compressor and condenser unit of claim 13, wherein the compressor and condenser unit casing is divided into a suction casing corresponding to the suction unit and a discharge casing corresponding to the discharge unit, and the fan frame reinforces and supports the discharge casing.

17. The compressor and condenser unit of claim 16, further comprising fan frame guides having their one sides coupled to the suction casing and their other sides contacting the fan frame.

18. The compressor and condenser unit of claim 17, wherein the other sides of the fan frame guides contact the inside of the fan frame.

19. The compressor and condenser unit of claim 18, further comprising a coupling member for fixing the fan frame guides to the fan frame.

20. The compressor and condenser unit of claim 17, wherein the ends of the other sides of the fan frame guides have surfaces slanted to the inside of the compressor and condenser unit.

21. The compressor and condenser unit of claim 1, further comprising a louver frame configured to be attached to an outer wall of a building, wherein the louver frame is attached to the opened surface of the unit casing, and wherein the louver frame includes a suction area adjacent the suction unit and a discharge area adjacent to the discharge unit.

22. The compressor and condenser unit of claim 21, wherein the louver frame comprises an external frame, and an internal frame configured to be fastened to the external frame, wherein the internal frame includes the louver blades.

23. A front suction and discharge type compressor and condenser unit for an air conditioner, comprising:

a compressor and condenser unit casing being formed in a rectangular parallelepiped shape, having its one surface externally opened and its other surfaces closed, and being divided into a suction unit and a discharge unit;

a compressor installed in the compressor and condenser unit casing, for compressing a refrigerant gas supplied from an indoor unit through pipe lines;

an air-cooled condenser installed in the suction unit of the compressor and condenser unit casing, for condensing the refrigerant gas from the compressor; and a sirocco cooling fan installed in the discharge unit of the compressor and condenser unit casing, for supplying external air to the air-cooled condenser through the suction area, and discharging heat exchanged air through the discharge area, wherein a housing of the sirocco cooling fan comprises a drainage structure.

24. The compressor and condenser unit of claim 23, wherein one suction orifice of the sirocco cooling fan faces the surface of the unit casing contacting the one opened surface and being farthest from the suction unit among the other surfaces, and the other orifice faces the suction unit.

25. The compressor and condenser unit of claim 24, wherein a motor of the sirocco cooling fan is positioned adjacently to the suction orifice below the surface of the compressor and condenser unit casing.

26. The compressor and condenser unit of claim 24, further comprising a dividing plate for intercepting gaps between the cooling fan and the inside surface of the compressor and condenser unit casing so that external air from the suction unit can be sucked through the suction orifice of the sirocco cooling fan facing the air-cooled condenser and discharged.

27. The compressor and condenser unit of claim 24, wherein the drainage structure comprises a drainage caved-in unit formed on the bottom of the housing, a drainage hole formed on the lowest surface of the caved-in unit, and a drainage hose extended from the drainage hole.

28. The compressor and condenser unit of claim 24, wherein the drainage structure comprises a drainage hole formed on the lowest surface of the housing, and a drainage hose extended from the drainage hole.

29. The compressor and condenser unit of claim 23, wherein the suction orifices of the sirocco cooling fan face two surfaces of the unit casing contacting the one opened surface among the other surfaces.

30. The compressor and condenser unit of claim 29, wherein the motor of the sirocco cooling fan is installed adjacent the suction orifice facing one of the two surfaces, and a width of fan blades in the side where the motor is installed is smaller than that of fan blades in the opposite side.

31. The compressor and condenser unit of claim 29, wherein the motor of the sirocco cooling fan is installed adjacent the suction orifice facing one side of the two surfaces, and the sirocco cooling fan is eccentrically installed to the side where the motor has been formed relative to a central line of the air-cooled condenser.

32. The compressor and condenser unit of claim 23, wherein the discharge unit of the compressor and condenser unit casing further comprises a fan supporting member for supporting the cooling fan.

33. The compressor and condenser unit of claim 32, wherein the supporting member comprises a fan frame for reinforcing and supporting the edges of the discharge unit, and a fan bracket for fixedly coupling at least one surface of a housing of the sirocco cooling fan to the fan frame.

34. The compressor and condenser unit of claim 33, wherein the fan frame comprises a flange unit facing the inside of the discharge unit and contacting the housing of the sirocco cooling fan on the surface contacting one opened surface.

35. The compressor and condenser unit of claim 34, further comprising a coupling member for fixing the flange to the housing of the sirocco cooling fan.

36. The compressor and condenser unit of claim 33, wherein the compressor and condenser unit casing is divided into a suction casing corresponding to the suction unit and a discharge casing corresponding to the discharge unit, and the fan frame reinforces and supports the discharge casing.

37. The compressor and condenser unit of claim 33, further comprising fan frame guides having theft one sides coupled to the suction casing and their other sides contacting the fan frame.

38. The compressor and condenser unit of claim 37, wherein the other sides of the fan frame guides contact the inside of the fan frame.

39. The compressor and condenser unit of claim 38, further comprising a coupling member for fixing the fan frame guides to the fan frame.

40. The compressor and condenser unit of claim 37, wherein the ends of the other sides of the fan frame guides have surfaces slanted to the inside of the unit casing.

41. A front suction and discharge type compressor and condenser unit for an air conditioner, comprising:

a compressor and condenser unit casing being formed in a rectangular parallelepiped shape, having its one surface externally opened and its other surfaces closed, and being divided into a suction unit and a discharge unit;

a compressor installed in the compressor and condenser unit casing, for compressing a refrigerant gas supplied from an indoor unit through pipe lines;

an air-cooled condenser installed in the suction unit of the compressor and condenser unit casing, for condensing the refrigerant gas from the compressor; and a sirocco cooling fan installed in the discharge unit of the compressor and condenser unit casing, for supplying external air to the air-cooled condenser through the suction unit, and discharging heat exchanged air through the discharge unit, wherein one suction orifice of the sirocco cooling fan faces the surface of the unit casing contacting the one opened surface and being farthest from the suction unit among the other surfaces, and the other orifice faces the suction unit.

42. The compressor and condenser unit of claim 41, wherein a motor of the sirocco cooling fan is positioned adjacently to the suction orifice below the surface of the compressor and condenser unit casing.

43. The compressor and condenser unit of claim 42, further comprising a dividing plate for intercepting gaps between the cooling fan and the inside surface of the compressor and condenser unit casing so that external air from the suction unit can be sucked through the suction orifice of the sirocco cooling fan facing the air-cooled condenser and discharged.

44. The compressor and condenser unit of claim 41, wherein the discharge unit of the compressor and condenser unit casing further comprises a fan supporting member for supporting the cooling fan.

45. The compressor and condenser unit of claim 44, wherein the supporting member comprises a fan frame for reinforcing and supporting the edges of the discharge unit, and a fan bracket for fixedly coupling at least one surface of a housing of the sirocco cooling fan to the fan frame.

46. The compressor and condenser unit of claim 45, wherein the fan frame comprises a flange unit facing the inside of the discharge unit and contacting the housing of the sirocco cooling fan on the surface contacting the one opened surface.

47. The compressor and condenser unit of claim 46, further comprising a coupling member for fixing the flange to the housing of the sirocco cooling fan.

48. The compressor and condenser unit of claim 45, wherein the compressor and condenser unit casing is divided into a suction casing corresponding to the suction unit and a discharge casing corresponding to the discharge unit, and the fan frame reinforces and supports the discharge casing.

49. The compressor and condenser unit of claim 48, further comprising fan frame guides having their one sides coupled to the suction casing and their other sides contacting the fan frame.

50. The compressor and condenser unit of claim 48, wherein the other sides of the fan frame guides contact the inside of the fan frame.

51. The compressor and condenser unit of claim 50, further comprising a coupling member for fixing the fan frame guides to the fan frame.

52. The compressor and condenser unit of claim 49, wherein the ends of the other sides of the fan frame guides have surfaces slanted to the inside of the compressor and condenser unit.

53. A front suction and discharge type compressor and condenser unit for an air conditioner, comprising:

a compressor and condenser unit casing being formed in a rectangular parallelepiped shape, having its one surface externally opened and its other surfaces closed, and being divided into a suction unit and a discharge unit;

a compressor installed in the compressor and condenser unit casing, for compressing a refrigerant gas supplied from an indoor unit through pipe lines;

an air-cooled condenser installed in the suction unit of the compressor and condenser unit casing, for condensing the refrigerant gas from the compressor; and a sirocco cooling fan installed in the discharge unit of the compressor and condenser unit casing, for supplying external air to the air-cooled condenser through the suction area, and discharging heat exchanged air through the discharge area, wherein suction orifices of the sirocco cooling fan face two surfaces of the unit casing contacting the one opened surface among the other surfaces.

54. The compressor and condenser unit of claim 53, wherein a motor of the sirocco cooling fan is installed adjacent the suction orifice facing one of the two surfaces, and a width of fan blades in the side where the motor is installed is smaller than that of fan blades in the opposite side.

55. The compressor and condenser unit of claim 53, wherein the motor of the sirocco cooling fan is installed adjacent the suction orifice of the sirocco cooling fan facing one side of the two surfaces, and the sirocco cooling fan is eccentrically installed to the side where the motor has been formed relative to a central line of the air-cooled condenser.

56. The compressor and condenser unit of claim 53, wherein the discharge unit of the compressor and condenser unit casing further comprises a fan supporting member for supporting the cooling fan.

57. The compressor and condenser unit of claim 56, wherein the supporting member comprises a fan frame for reinforcing and supporting the edges of the discharge unit, and a fan bracket for fixedly coupling at least one surface of a housing of the sirocco cooling fan to the fan frame.

58. The compressor and condenser unit of claim 57, wherein the fan frame comprises a flange unit facing the inside of the discharge unit and contacting the housing of the sirocco cooling fan on the surface contacting the one opened surface.

59. The compressor and condenser unit of claim 58, further comprising a coupling member for fixing the flange to the housing of the sirocco cooling fan.

60. The compressor and condenser unit of claim 57, wherein the compressor and condenser unit casing is divided into a suction casing corresponding to the suction unit and a discharge casing corresponding to the discharge unit, and the fan frame reinforces and supports the discharge casing.

61. The compressor and condenser unit of claim 60, further comprising fan frame guides having their one sides coupled to the suction casing and their other sides contacting the fan frame.

62. The compressor and condenser unit of claim 61, wherein the other sides of the fan frame guides contact the inside of the fan frame.

63. The compressor and condenser unit of claim 62, further comprising a coupling member for fixing the fan frame guides to the fan frame.

64. The compressor and condenser unit of claim 61, wherein the ends of the other sides of the fan frame guides have surfaces slanted to the inside of the compressor and condenser unit casing.

* * * * *